US009113725B1

(12) United States Patent
Nipp

(10) Patent No.: US 9,113,725 B1
(45) Date of Patent: Aug. 25, 2015

(54) CLAMP AND CLAMP SYSTEM FOR MULTIPLE USES

(76) Inventor: Christopher A. Nipp, San Pedro, CA (US)

( * ) Notice: Subject to any disclaimer, the term of this patent is extended or adjusted under 35 U.S.C. 154(b) by 120 days.

(21) Appl. No.: 13/612,326

(22) Filed: Sep. 12, 2012

(51) Int. Cl.
*A47F 5/00* (2006.01)
*A47B 96/00* (2006.01)

(52) U.S. Cl.
CPC ..... *A47F 5/0068* (2013.01); *A47F 5/0025* (2013.01)

(58) Field of Classification Search
CPC ... A47F 5/0068; A47F 5/0025; A47B 96/025; A47B 96/06
USPC ..... 248/214, 314, 316.1, 231.31, 231.37, 248/231.41, 558, 231.71, 316.4, 226.21, 248/229.1; 108/25, 26, 97, 98; 211/86.01, 211/119.003, 126.1, 134, 186; 269/210, 269/216, 249
See application file for complete search history.

(56) References Cited

U.S. PATENT DOCUMENTS

| | | | | |
|---|---|---|---|---|
| 2,947,589 | A | 8/1960 | Darbo | |
| 3,317,260 | A | 5/1967 | Levit et al. | |
| 3,325,038 | A | 6/1967 | Ferney | |
| 3,744,645 | A * | 7/1973 | Hochman | 211/86.01 |
| 3,949,880 | A | 4/1976 | Fortunato | |
| 4,032,101 | A * | 6/1977 | Immordino | 248/231.31 |
| 4,213,649 | A | 7/1980 | Sell | |
| 4,560,128 | A | 12/1985 | Willeby et al. | |
| 4,884,512 | A * | 12/1989 | Kelly et al. | 108/26 |
| 5,190,257 | A | 3/1993 | Gradei et al. | |
| 5,244,272 | A | 9/1993 | Thompson | |
| 5,274,888 | A * | 1/1994 | Payne | 24/277 |
| 5,595,378 | A * | 1/1997 | Martinsson et al. | 269/210 |
| 5,799,803 | A | 9/1998 | Muller | |
| 5,822,918 | A * | 10/1998 | Helfman et al. | 248/231.41 |
| 6,021,908 | A | 2/2000 | Mathews | |
| 6,026,972 | A | 2/2000 | Makowski | |
| 6,257,439 | B1 | 7/2001 | Hsu | |
| D456,182 | S | 4/2002 | Hamilton et al. | |
| 6,557,711 | B2 | 5/2003 | Grueneberg | |
| 6,708,966 | B1 * | 3/2004 | Troudt | 269/249 |
| 7,128,221 | B2 | 10/2006 | Metcalf | |
| 7,284,737 | B2 | 10/2007 | Kane | |
| 7,527,158 | B2 | 5/2009 | Gainer et al. | |

(Continued)

OTHER PUBLICATIONS

Woodcraft; Buy Drawer Slide Brackets (2) at Woodcraft; www.woodcraft.com; Jun. 12, 2012; two pages.

(Continued)

*Primary Examiner* — Tan Le
(74) *Attorney, Agent, or Firm* — David L. Hoffman; Hoffman Patent Group

(57) ABSTRACT

An adjustable multifunctional clamping unit which allows a user to secure various apparatus such as cutting boards and work boards to provide additional workspace surfaces, also allows a user to secure various organizational and storage apparatuses such as containers to various surfaces and fixtures to provide space saving organization and storage solutions. The clamping unit may be configured to be secured to a work surface such as a cutting board such that the apparatus allows for attachment of a convenient and secure container for brushing items off of the cutting board and into a container. Another embodiment may include an adjustable clamping unit configured to secure a working board surface in an elevated position above a flat work or storage surface. A further embodiment may include an adjustable clamping unit configured to secure a working board or cutting board above a void created by an open drawer.

9 Claims, 19 Drawing Sheets

(56) References Cited

U.S. PATENT DOCUMENTS

| | | | | |
|---|---|---|---|---|
| 7,641,056 | B2 | 1/2010 | Schulman | |
| 7,735,800 | B2 * | 6/2010 | Lunato et al. | 248/558 |
| 7,789,366 | B2 * | 9/2010 | McDonald | 248/316.4 |
| 7,922,022 | B2 | 4/2011 | Ciarrocchi, Jr. | |
| 7,959,121 | B1 | 6/2011 | Barnes, Jr. | |
| 8,015,927 | B1 | 9/2011 | Helline | |
| 8,113,127 | B2 * | 2/2012 | Helline | 108/26 |
| 8,167,128 | B2 | 5/2012 | McGinnis et al. | |
| 2006/0113263 | A1 | 6/2006 | Kratochvil | |
| 2009/0120832 | A1 | 5/2009 | Munden | |
| 2010/0162928 | A1 | 7/2010 | Helline | |
| 2011/0232536 | A1 | 9/2011 | Moravec et al. | |
| 2011/0253867 | A1 | 10/2011 | Purgatorio et al. | |

OTHER PUBLICATIONS woodcraft.com; Drawer Slide Brackets; Jun. 12, 2012; two (2) pages; Parkersburg, West Virginia.

* cited by examiner

CLAMP AND CLAMP SYSTEM FOR MULTIPLE USES

BACKGROUND OF THE INVENTION

1. Field of the Invention

The present invention relates generally to a multifunctional clamp apparatus and clamp system configured to secure various items such as cutting boards, workspace boards, containers, and receptacles to a wide variety of horizontal planar surfaces and edges, such as table tops, desks, counters, shelves, and drawers.

2. Description of the Related Art

The tasks of organization and space-saving have traditionally posed a frustrating exercise, especially for those with limited space in their living or work spaces. Users have traditionally tried using various containers or receptacles for organization and storage of items, only to have the containers and receptacles take up valuable tabletop, counter, or work space. In addition, using unsecured containers and receptacles for storage and organization often leads to additional clutter to the user's living space or workspace thereby exacerbating the issue. Further, the ability to move items, such as cut food on a cutting board or countertop, toys with small parts, nuts, bolts, nails, screws, buttons, or crafts, into a container without having to hold the container, would be desirable.

For example, users are often faced with limited storage and tabletop or countertop space in the kitchen, especially those who live and/or spend time in smaller homes, apartments, RVs, mobile homes, modular homes, boats or the like. This may become an issue when preparing a meal in the kitchen and limited countertop space prevents users from comfortably preparing or organizing ingredients. Additionally, people with limited space in their offices or workspaces are often left frustrated by the lack of storage space or desktop space available for getting work accomplished. For example, extra work or storage space would be very useful for hobbyists, crafters, and professionals with smaller or limited work or office space, and students with small study desks or those living in college dormitories which are often notoriously cramped.

It is desirable to have an adjustable multifunctional clamp apparatus and clamp system which allows a user to secure various apparatuses such as cutting boards and work boards to provide additional workspace surfaces, and which further allow a user to secure various organizational and storage apparatuses such as containers or receptacles, regardless of size of the container or receptacle, to various surfaces and fixtures to provide space saving organization and storage solutions. The apparatus may further be configured to be secured to a side edge of a work surface such as a cutting board such that the apparatus allows for attachment of a convenient and secure container for brushing items off of the cutting board surface and into the storage space of the container.

Traditional apparatuses and systems have thus far failed to provide an adequate solution to the problem. U.S. Pat. No. 8,015,927 and U.S. Patent Publication No. 2010/0162928 to Helline disclose a cleaning tray with gripping parts for removably engaging a table outer edge which has a removable receptacle for receiving trash centered in the main body, and a compartment attached to a rear side of the main body. The Helline references do not allow for adjustability of the gripping parts to accommodate various sizes of receptacles. The Helline references also do not allow for alternative configurations and uses for organization and space saving functionality.

U.S. Pat. No. 3,949,880 to Fortunato discloses a shelf extending apparatus for presenting a product forward of a shelf. The apparatus has a container for holding and displaying the product in the container. The apparatus includes a rear wall configured to receive a clamp having a pair of spaced arms cantilevered therefrom. However, Fortunato does not allow for use of the shelf extending apparatus in combination with various receptacles or containers. Fortunato also does not allow for alternative configurations and uses for organization and space saving functionality.

U.S. Pat. No. 6,026,972 to Makowski discloses a debris receptacle apparatus for attachment to a cutting board including a bag holding frame, a U-shaped backstop, attached legs, and a leg holding plate. The apparatus is configured to be fixed to the underside of a standard cutting board. A more secure attachment mechanism and the ability to use one's existing containers of any size is lacking in Makowski.

There is a need for an adjustable multifunctional clamp apparatus and clamp system which allows a user to secure various apparatuses such as cutting boards and work boards to provide additional workspace surfaces, and which further allow a user to secure various organizational and storage apparatuses such as containers or receptacles of various sizes and shapes to various surfaces and fixtures to provide space saving organization and storage solutions.

SUMMARY OF THE INVENTION

In one embodiment, there is a pair of clamping units for sliding onto and engaging an edge of a table, shelf, cutting board, or other edge surface. The clamping units may include receiving channels formed in each of the clamping units configured to receive an edge or lip of various objects, such as container. In this manner, the object is engaged with the channels such that the object (e.g., plastic container) is secured to the edge surface by the clamping units. The clamping units may further include adjustable retention mechanisms configured to be tightened or loosened by the user in order to create a forceful secure grip of the clamping units on the edge surface.

In a preferred embodiment, at least three clamping units may be provided which are configured to secure a working board in an elevated position on a flat surface to create additional storage and workspace. The clamping units may each be configured with a flat bottom surface to allow the clamping units to be placed in an upright position while each clamping unit is configured to receive and secure an edge of a working board. The clamping units may include adjustable retention mechanisms as previously discussed to create a forceful secure grip on the edges of the board. The height of the elevation of the board may be defined by the size and height of the clamping units. Alternatively, the clamping units may include an adjustable height mechanism to lower or raise the elevation level of the working board.

In another preferred embodiment, there is a pair of clamping units for securing a working board above an open drawer area to create additional working or storage space on the edge of a countertop or table surface. The clamping units may include a clamping portion configured to receive and secure an edge of a working board. The clamping units may further include a securing portion configured to extend into and engage an upper ceiling of a drawer while the board is supported by an upper edge of a front surface of a drawer that remains open. The securing portion may include an adjustable mechanism to allow the clamp to be secured to drawer openings of various sizes.

In another preferred embodiment, the clamping units may include dual clamping portions, wherein one clamping end is configured to secure to a shelf, board, table, or upper surface of a drawer, while the another clamping end is also configured to secure to a shelf, board, or table. In a variation of this embodiment or any other embodiment, two clamping units each having a single clamping portion may attach together to form a clamping unit with dual clamping portions. The various clamps and pieces are preferably injection molded as one piece to the extent possible.

DESCRIPTION OF THE PREFERRED EMBODIMENT(S)

Figure 1:
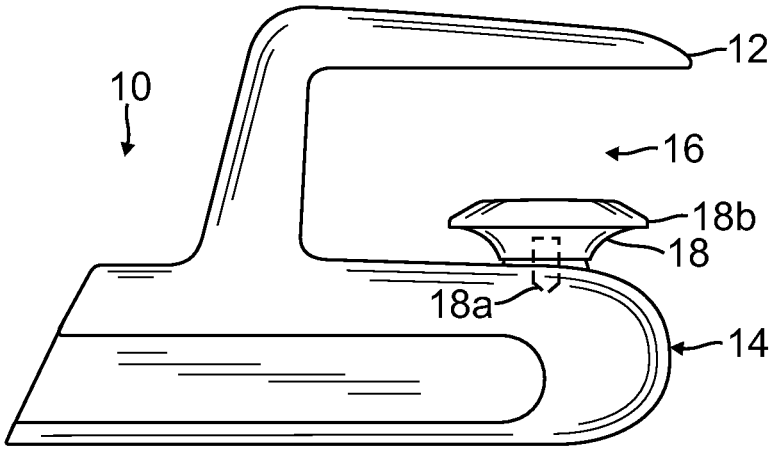
FIG. 1 is a side view of a clamping unit in accordance with a first embodiment of the invention.

The disclosure provided in the following pages describes examples of some embodiments of the invention. The designs, figures, and description are non-limiting examples of certain embodiments of the invention. For example, other embodiments of the disclosed systems and methods may or may not include the features described herein. Moreover, disclosed advantages and benefits may apply to only certain embodiments of the invention and should not be used to limit the disclosed inventions. Further, parts which appear to be alike in the drawings are intended to be alike and/or have the same or similar function to like or similar parts in other drawings, as would be evident to one of ordinary skill in the art.

In an embodiment, there is an adjustable multifunctional clamping unit and clamp system which allows a user to secure various apparatuses or objects such as cutting boards, lap desks and work boards to provide additional workspace surfaces, and which further allows a user to secure various organizational and storage apparatuses or objects such as containers or receptacles of different shapes and sizes to various surfaces and fixtures to provide space saving organization and storage solutions. The clamping unit may further be configured to be secured to a side edge of a work surface such as a cutting board such that the apparatus allows for attachment of a convenient and secure container for brushing items off of the cutting board surface and into the storage space of the container. The clamping unit may also hold a computer, such as a tablet computer, notebook or laptop computer, preferably by inverting the clamping units and sliding the edges of the computer into channels in the clamping units.

Another embodiment may include an adjustable clamping unit and clamp system configured to secure a working surface or board in an elevated position above a flat work or storage surface. In a further embodiment the system may include an adjustable clamping unit and clamp system configured to secure a working board or cutting board above a void created by an open drawer.

Other embodiments are also disclosed herein.

Turning now to FIG. 1, a side view of an embodiment of a clamping unit 10 is shown. The clamping unit 10 may include an upper clamp arm 12 and a lower clamp portion 14 defining a clamp void 16 configured to receive and secure a surface edge, such as an edge of a table, shelf, working board, cutting board, or other surface. The clamping unit 10 may further include an adjustable securing mechanism to allow the user to secure the upper clamp arm 12 and lower clamp portion 14 on surface edges of varying textures and widths. In the embodiment depicted in FIG. 1, the adjustable securing mechanism includes a retractable stop 18 positioned on the lower clamp portion 14 within the void 16. In the depicted embodiment, the user is able to move the retractable stop 18 upwards by rotating the stop in a first direction, e.g., a counterclockwise direction, or downward by rotating it in a second direction, e.g., clockwise direction (or visa versa). The mechanism to adjust retractable stop 18 may be, e.g., a threaded bolt 18*a* screwed into the lower clamp portion 14 and having a head 18*b* which may have a friction surface for better attachment or a low friction surface, as desired.

With this configuration, the user is able to place a surface edge within void 16 and tightly secure clamping unit 10 to the surface edge by rotating stop 18 in the appropriate direction until the upper clamp arm 12 and stop 18 create a vice-like grip on opposite surfaces of the surface edge. In another version of this embodiment, clamping unit 10 may include an adjustable upper clamp arm which may be adjusted upwards or downwards in order to similarly create a secure grip on an opposite surface of a surface edge from lower clamp portion 14.

Alternatively, another version may include an adjustable securing mechanism such as a retractable stop positioned on upper clamp arm 12 (comparable to and in place of stop 18 or in addition to stop 18). In all embodiments, upper clamp arm 12, lower clamp portion 14, an adjustable securing mechanism such as stop 18, or a combination thereof are preferably configured such that void 16 provides a maximum width and a minimum width ideally suited to receive a variety of sizes of surface edges.

Figure 2:
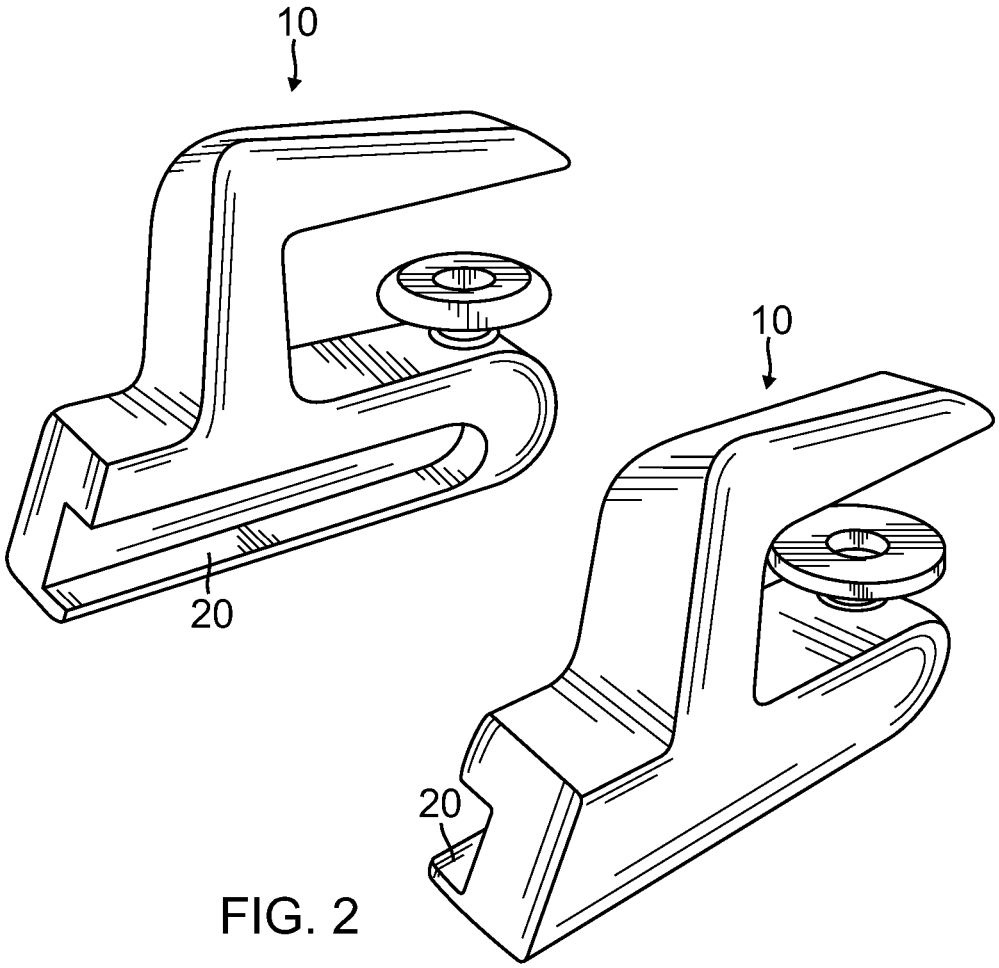
FIG. 2 is a perspective view of a pair of clamping units of the embodiment of FIG. 1, each unit being constructed as a mirror image of the other.

FIG. 2 is a perspective view of the embodiment of FIG. 1. Each clamping unit 10 may include a receiving channel 20 formed on a first side. Each receiving channel is configured to receive a protruding edge or lip of a container. In a clamp system embodiment of the present invention, a pair of clamping units 10 is provided, each clamping unit preferably having a mirror image and including receiving channel 20, each receiving channel being formed on opposing sides of the two clamping units. Accordingly, when the pair of clamping units are secured to a surface edge, the receiving channels 20 are facing each other as shown in FIG. 2.

In another version, receiving channel 20 may include a rubberized surface for increasing frictional contact with a lip or edge of a container which has been inserted therein, which are common for plastic kitchen containers or the like, especially those which have a lid. In a further version, receiving channel 20 may include a retaining mechanism, such as a biased spring or clip to secure the lip or edge of a container.

Figure 3A:
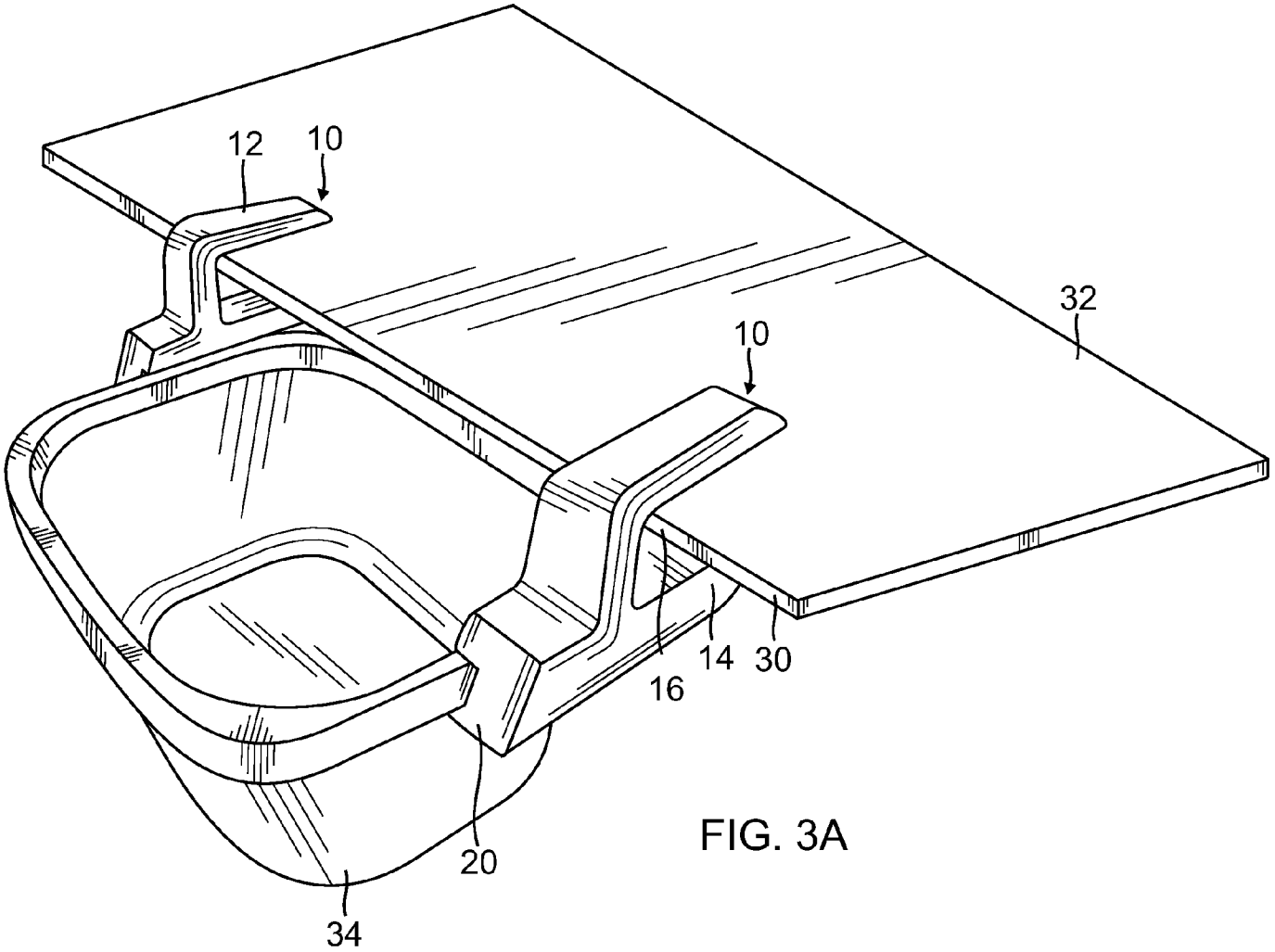
FIG. 3A is an in-use view of the pair of clamping units of FIG. 2.

FIG. 3A is an in-use view of the pair of clamping units such as those of FIG. 2. The clamping units are secured to an edge 30 of a tabletop or countertop surface 32 by positioning void 16 of each clamp 10 about the edge 30 such that the upper clamp arm 12 is positioned substantially above the upper surface of the surface edge, and the lower clamp portion 14 is positioned substantially below the lower surface of the surface edge. Each clamping unit includes receiving channel 20, located on opposing sides which are facing each other, such that a lip or edge of a container 34 may be inserted and secured within said receiving channels. In this manner, container 34 may be secured by clamping units 10 to the edge of a tabletop or countertop surface 32 such that a user may brush items off of the edge of the table or counter and into container 34.

Clamping units 10 may also be used to secure container 34 to an edge 30 of a cutting board such that the user is able to cut or slice food ingredients on the cutting board surface and conveniently slide the ingredients off of the edge of the cutting board and into container 34 for serving or cooking.

Figure 3B:
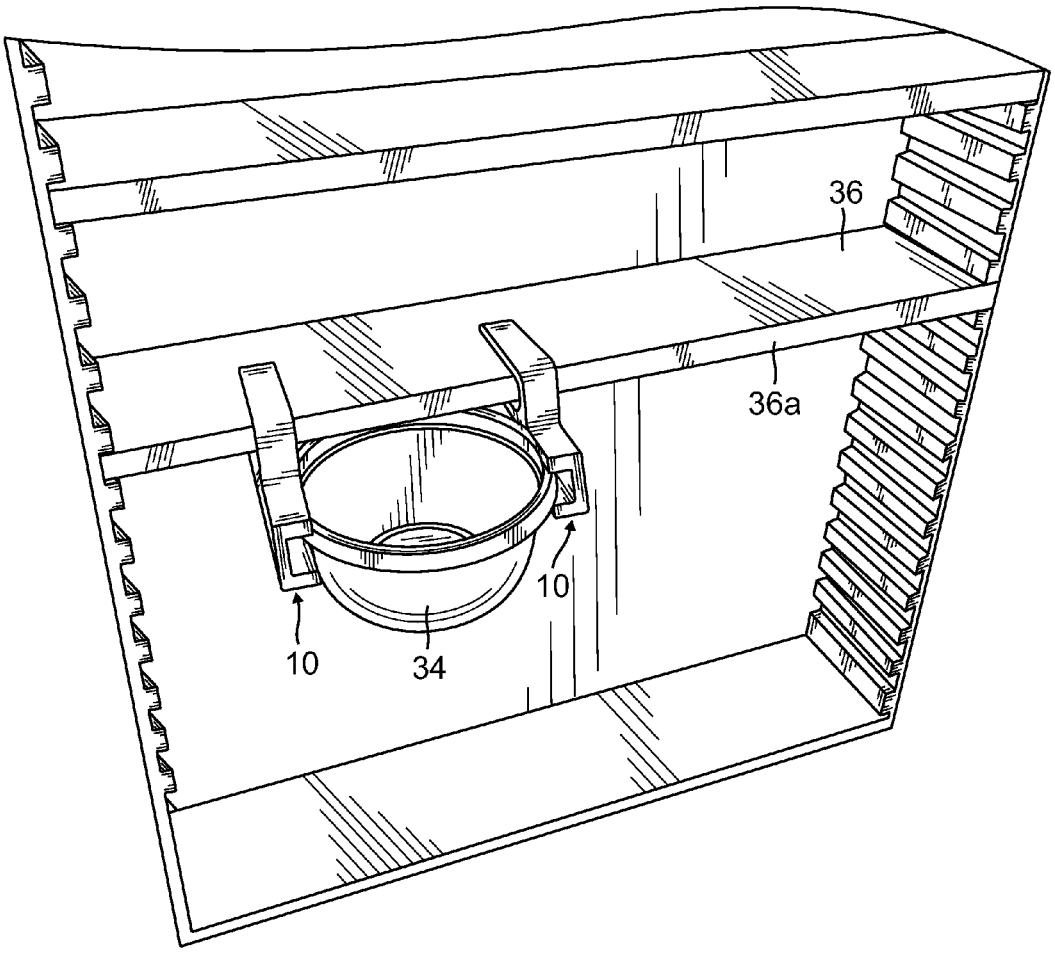
FIG. 3B is an in-use view of the pair of clamping units of FIG. 2 showing an alternative use.

FIG. 3B is an in-use view of the pair of clamping elements of FIG. 2 in an alternative use. Here, clamping units 10 may be secured to an edge 36*a* of a shelf 36 of a bookcase or shelving unit. In another use, clamping units depicted in FIG. 3B may be used as a display unit, such as providing additional display space for product items placed within container 34. This use may be effective to present items to a shopper or consumer in a manner which sets the items displayed inside the container apart from those displayed on the shelf 36 due to their forward-jutted position relative to the shelving unit. It may also be effective for providing items which are small and/or individually sold and/or which complement or relate to the items placed on the surface of shelf 36. For example, packaged candy products may be displayed on shelf 36, and the clamping units 10 and container 34 may be used in combination to present and offer samples of the candy products.

The shelf may have multiple pairs of clamping units each holding a respective object, such as a container. The containers may be of different sizes and shapes (such as shown throughout the drawings), e.g., rectangular, square, oval, round, and/or other shape.

Figure 4:
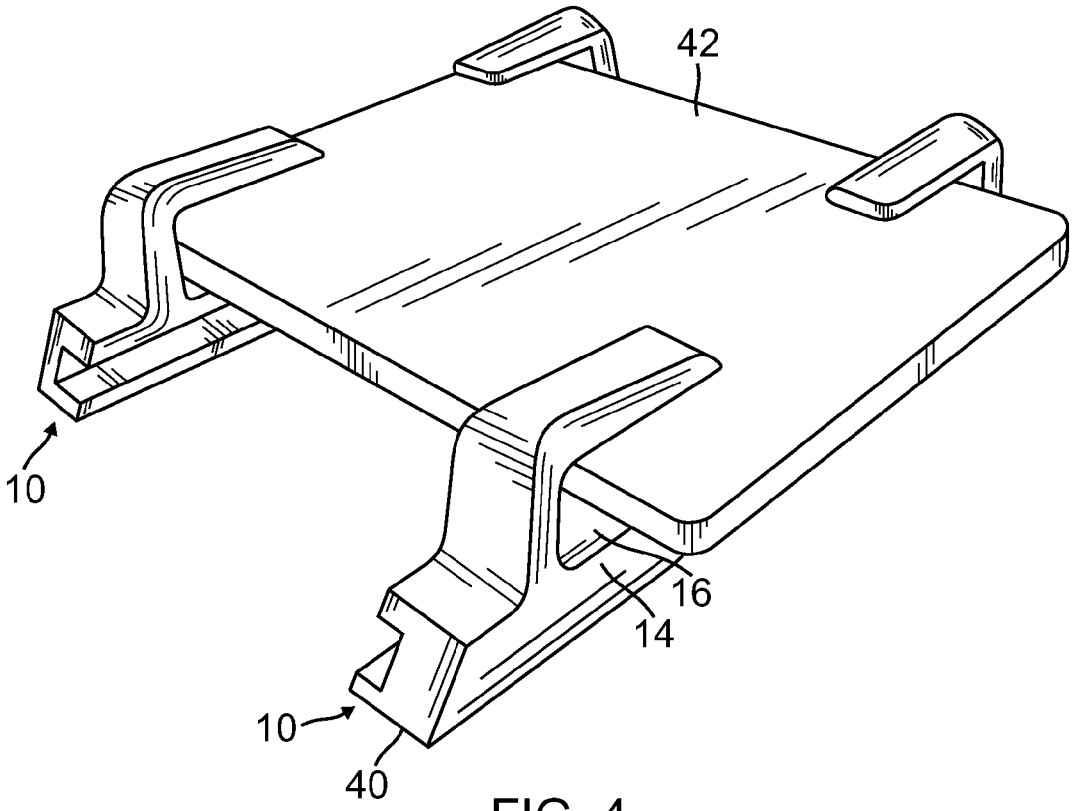
FIG. 4 is an in-use view of the clamping units of FIG. 2 showing another alternative use.

FIG. 4 shows another in-use view of clamping units of FIGS. 1 to 3. Here, clamping units 10 may be used to elevate a working surface, such as a flat board 42. The clamping units 10 may include a substantially flat bottom surface 40 such that the units are able to rest on a tabletop, countertop, or other substantially flat surface in a standing position. The clamping units may also be configured such that the upper surface of lower clamp portion 14 provides a stable resting surface for a flat board 42 such as a cutting board or working board which has been inserted into clamp void 16. In this embodiment, at least three clamping units may be used in combination to elevate a flat board 42 such as a working board, cutting board, or other rigid flat object above a substantially flat surface.

In FIG. 4, four clamping units 10 are used to support the four corners of a flat board 42 in an elevated position. This use may allow a user to elevate a flat board 42 above a tabletop or countertop surface to provide additional working space or storage space underneath the elevated board.

Lower clamp portion 14 preferably includes retractable stop 18 shown in FIG. 1 to allow the user to create a secure grip of upper clamp arm 12 and lower clamp portion 14 on opposing surfaces of board 42. In this embodiment, cap 18*b* (forming an upper surface of the retractable stop) may be configured to provide a stable resting surface for board 42.

In another preferred embodiment, the retractable stop may be removable by the user from lower clamp portion 14 so as to utilize the stable resting surface provided by the upper surface of lower clamp portion 14.

Figure 5:
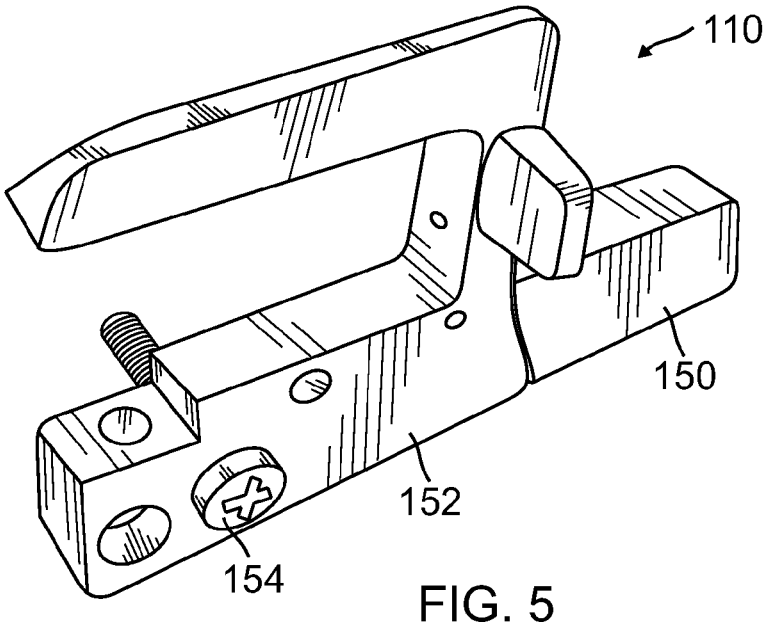
FIG. 5 is a perspective view of a clamping unit with a stabilizing portion in accordance with a second embodiment of the invention.

FIG. 5 shows another embodiment of a clamping unit 110. In this embodiment, the clamping unit may include a rear clamp portion 150 which may be retracted from front portion 152 of the clamping unit. Retracting the rear portion may provide the clamping unit 10 with an extended receiving channel 120 (FIG. 6), which functions as discussed in the above embodiment(s) such that the clamping unit is able to retain larger sized containers within the receiving channel.

The rear clamp portion 150 may also provide clamp 110 with a longer bottom surface to provide additional stability when the clamp is placed on a substantially flat surface such as in the "raised surface" use of FIG. 4.

The clamp may further include a retaining screw 154 (or bolt) to secure the rear clamp portion 150 to the desired retracted position from front clamp portion 152. A nut may be used as well on the retaining screw 154. In this embodiment, the user is able to adjust the length of the assembled clamp unit by adjusting the relative positions of rear clamp portion 150 and front clamp portion 152.

In another preferred embodiment, retaining screw 154 may be used to connect and secure a second clamping unit 154 in a side by side configuration, the second clamping unit configured to be a mirror-image opposite in relation to clamping unit 110. This combination may be used to increase the strength and rigidity of the clamp system or to increase the securing forces on a board by adding additional clamp arms.

Figure 6A:
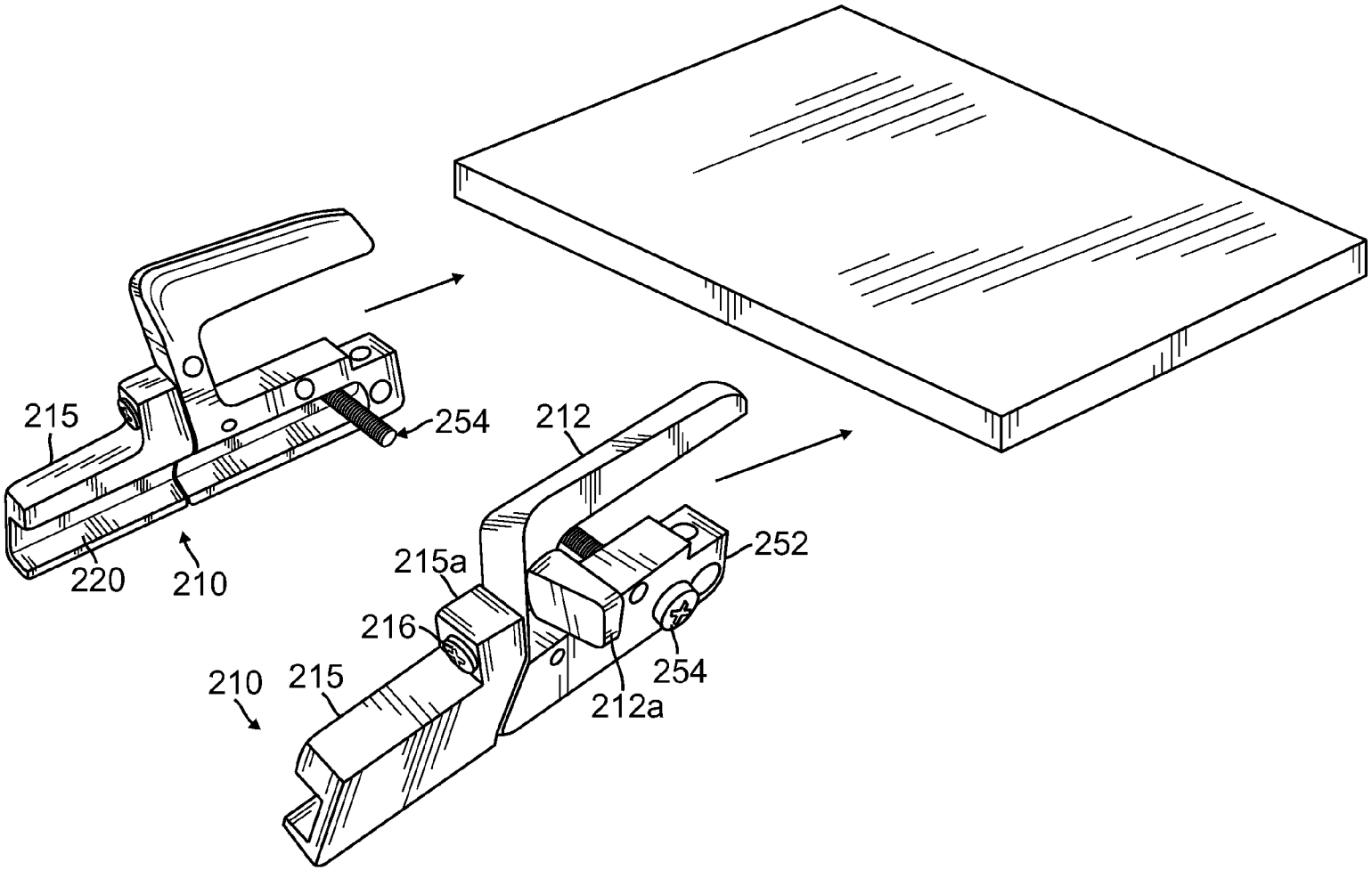
FIG. 6A is an in-use view of a pair of clamping units of FIG. 5 prior to connection position, each unit being constructed as a mirror image of the other.

In yet another preferred embodiment, a pair of opposing clamps 210 as shown in FIG. 6A may be connected together using retaining screws 254 such that the clamps are secured together at a predetermined distance apart from each other. Retaining screws 254 may also be positioned at the forward most end of receiving channel 220 such that retaining screws 254 provide a limiting stop for the protruding lip or edge of a container inserted into receiving channel 220. In this configuration, the container may be limited to a predetermined forward position such that the container is secured in a desired position within receiving channel 220. Front clamp portion 252 may further include a plurality of securing holes positioned at predetermined intervals such that retaining screws 254 may be adjustably secured therein to limit the forward positioning of container at various desired positions within receiving channel 220.

Upper clamp arm 212 has a flange 212A that may function as a stopper or stabilizer against rotation of the clamping unit when attached to a board or shelf or the like, as the flange will abut an edge of the board or shelf. Rear clamp portion 215 has a receiving channel 220 formed therein, and is shown attached at a tab portion 215A by a screw 216 to front clamp portion 252.

In another embodiment, the system may provide a central connecting unit (not pictured) having two ends, a first end having a threaded opening configured to receive retaining screw 254 of a first clamping unit, and a second end having a threaded opening configured to receive a retaining screw of a second clamping unit. The central connecting unit may allow the user to connect two opposing clamping units 210 with an adjustable length therebetween.

Figure 6B:
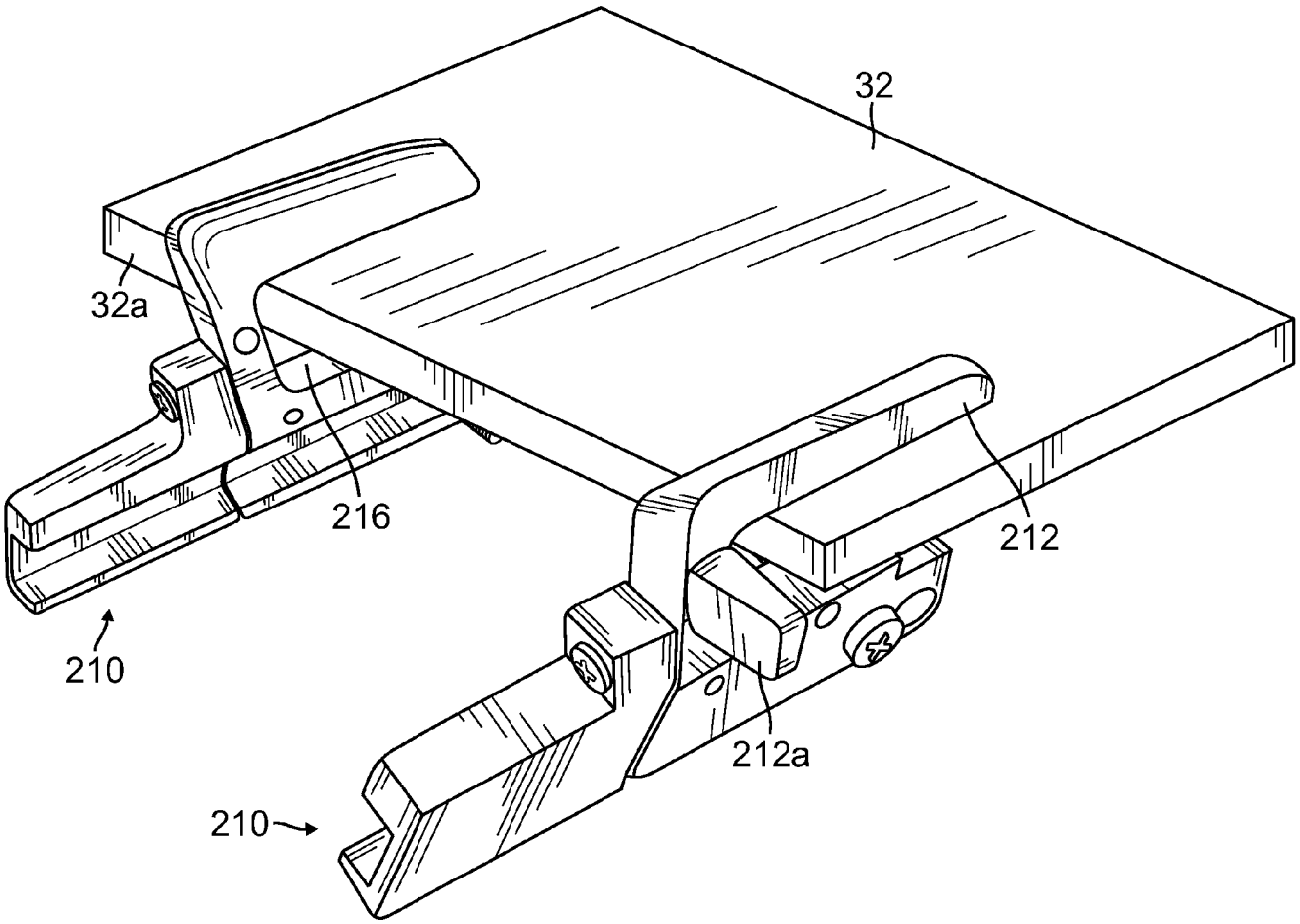
FIG. 6B is an in-use view of the pair of clamping units of FIG. 5 showing the clamping units in connected position.

FIG. 6B is an in-use view of the embodiments as discussed above in FIGS. 5 and 6A. FIG. 6B shows the clamping units 210 secured on the edge of a board, table, shelf, countertop, or other substantially flat surface 32. Flange 212A is shown proximate to and may abut a substantially vertical edge 32A of the board, table, shelf, countertop, or other substantially flat surface 32. When an edge of the flat surface 32 is inserted into void 216 of clamping unit 210, flange 212A may provide for an extended lateral surface of the clamping unit against which vertical edge 62 of the flat surface 32 may abut. The extended lateral surface provided by flange 212A helps prevent unintended rotation of clamping unit 210 about a vertical axis which might otherwise lead to an unstable grip of the clamping unit 210 upon the flat surface. In a preferred embodiment, the abutting surface of flange 212A may include a rubberized or other high friction surface to increase frictional contact with the vertical edge 62 of flat surface 32.

Figure 7:
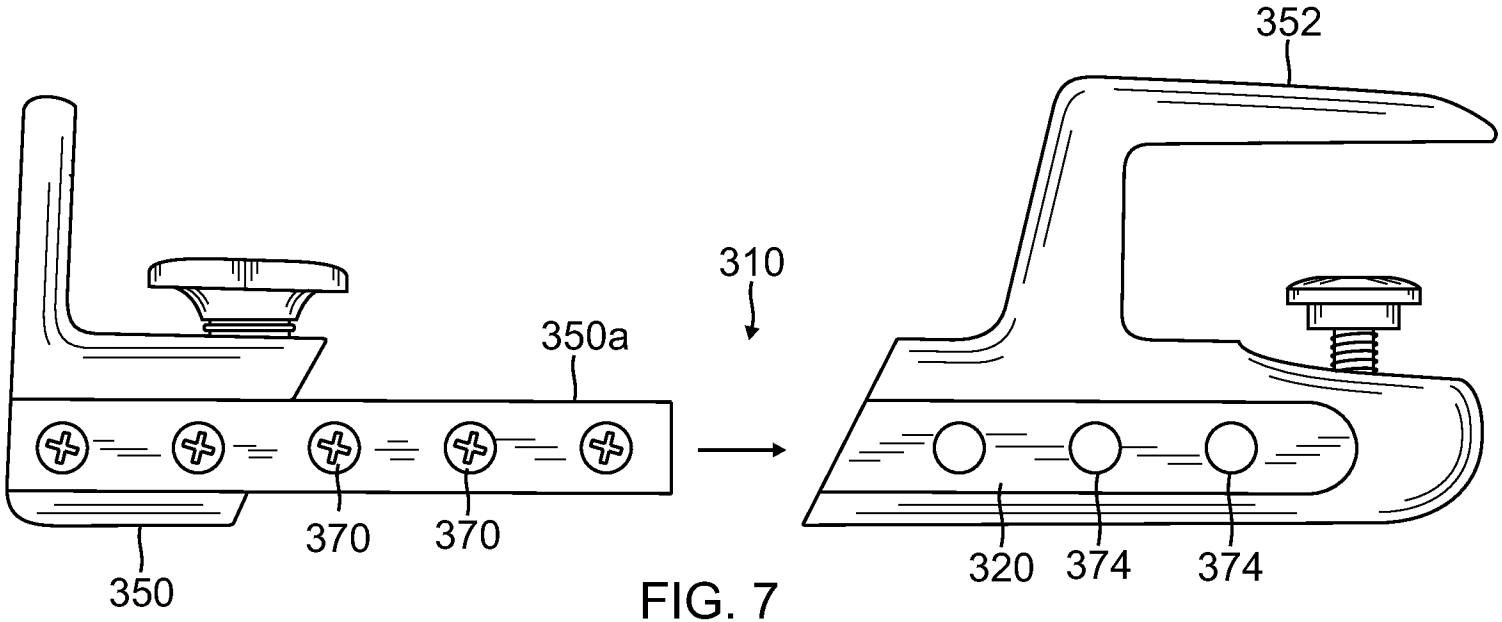
FIG. 7 is a side view of a clamping unit in accordance with a third embodiment of the invention.

FIG. 7 depicts another embodiment of a clamping unit 310. This embodiment may include a front clamp portion 352 embodiment similar to as shown and discussed in FIGS. 1 to 4, and a rear clamp portion 350 configured to slide securely into receiving channel 320 of the front clamp portion. In this embodiment (and if desired, in other embodiments), front clamp portion 352 and rear clamp portion 350 may include securing holes 374 configured to receive at least one securing screw 370 for adjusting the relative positions of the front and rear clamp portions to thereby adjust the length of the clamping unit. Preferably, a forward projection 350A of rear clamp portion 350 has a front cross-sectional shape and size to fit inside receiving channel 320 and preferably in a friction fit (see FIG. 8).

Figure 8:
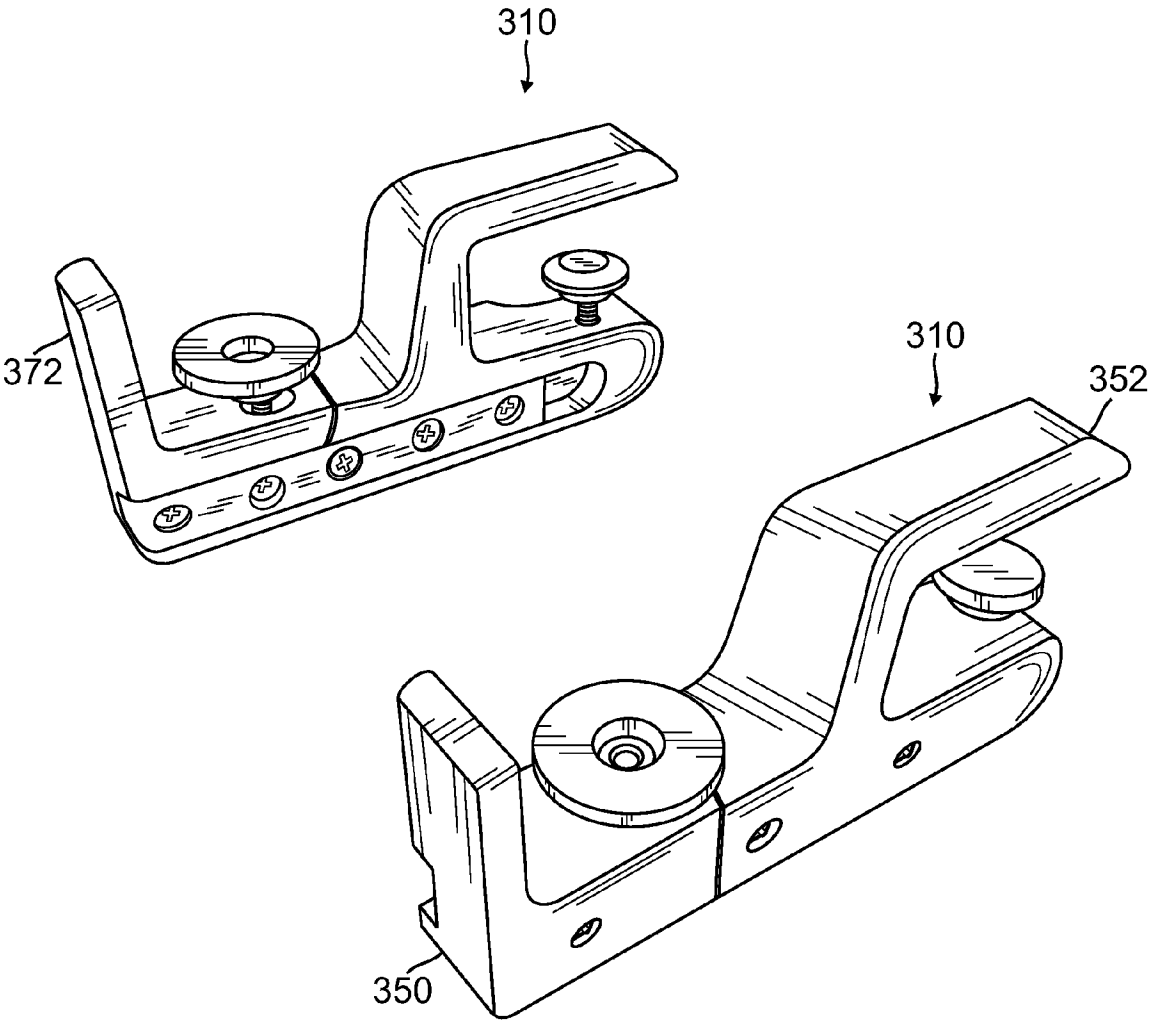
FIG. 8 is a perspective view of a pair of clamping units of FIG. 7.

In FIG. 8, there is a pair of clamping units 310 each having a front clamp portion 352 and a rear clamp portion 350 as discussed above in FIG. 7 are shown. FIG. 8 shows front clamp portion 352 and rear clamp portion 350 secured together with a plurality of screws 370 in a fully shortened position. In this figure, the front most clamping unit 310 includes a total of three aligned screw holes with front clamp portion 352 and rear clamp portion 350 in the fully shortened position, while the rear most clamping unit 310 includes a total of five aligned screw holes in the fully shortened position, as discussed above in FIG. 7. The pair of clamping units 310 may be used to secure a flat board such as a cutting board or working board adjacent to a flat surface such as a countertop by securing the board above the opening of an open drawer. In the depicted embodiment, rear clamp portion 350 may include an extended abutting member 372 positioned on a far rear end of the rear clamp portion. The extended abutting member 372 may be configured to extend into a drawer opening, and abut an upper ceiling of the drawer opening such that a flat board may be supported above an open drawer by the front clamp portion while the board is supported by an upper edge of a front surface of the drawer which remains open, as shown in other figures herein.

Figure 9:
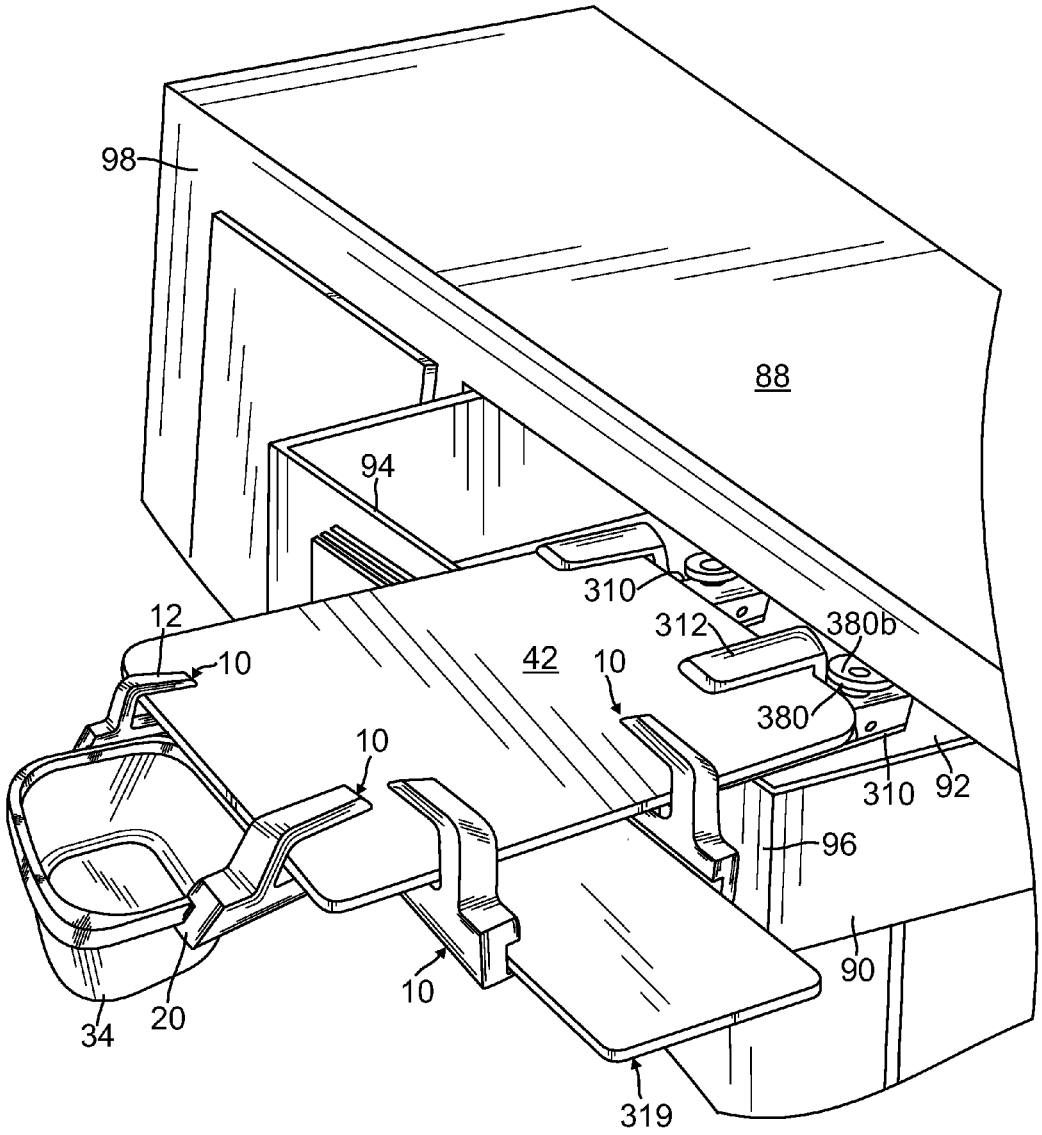
FIG. 9 is an in-use view of the pair of clamping units of FIG. 8 where the rear retractable stop abuts the underside of a front face of a desk, used in combination with the pair of clamping units of FIG. 3A to secure a container.

FIG. 9 shows an in-use view of a pair of clamping units 310 being used to secure a board 42 above an open drawer 90 of a cabinet 88. This configuration may further be used in conjunction with the clamping units 10 of FIG. 3A to secure a container 34 to the edge of board 42, as depicted. This combination may allow a user to perform certain tasks on the upper surface of board 42, such as using board 42 as a cutting board to cut food, then allowing the user to conveniently brush or slide the cut food into container 34 for transporting or storage.

The board 42 is secured above open drawer 90 by upper clamp arm 312 and lower clamp arm (obscured by board 42) while the rear clamp portion with extended abutting member is inserted into the drawer opening 92 created by open drawer 90. The clamping units 310 may be configured such that when the bottom surface of the board 42 is rested upon an upper edge 94 of the front surface 96 of the open drawer 90 such that a substantial majority of the weight of the board is placed opposite the clamping units 310 in relation to upper edge 94, the weight of the portion of board, which is cantilevered over the upper edge 94 causes a lever action whereby the upper edge 94 acts as a fulcrum thereby causing the extended abutting member (not depicted) of the rear clamp portion to be forced in an upward direction until it securely abuts the ceiling of the drawer opening 92 and/or until head 380B of a rear retractable stop 380 firmly abuts the lower edge of a front wall 92 of cabinet 88. The upward force on the rear clamp portion and the extended abutting member and/or the head 380B created by the levered weight of the board results in the board 42 being attached by the pair of clamping units in a secure position above the drawer opening such that a user is able to utilize the upper surface of the board for additional work space or storage space.

The extended abutting member 372 may also act to prevent the clamping units 310 from unintentionally being removed from the opening created by the open drawer 90 by abutting the rear surface of front cabinet wall 98 positioned above the open drawer 90 if the uneven distribution of the weight of the board 42 in relation to the upper edge 94 of the front surface 96 of the open drawer 90 causes the board to slide forward and out of the drawer opening. The surface of the extended abutting member 372 may be comprised of a high friction material such as rubber or soft plastic to increase frictional contact with other surfaces, such as the upper ceiling of the drawer opening 92 or the rear surface of front wall 98 of the cabinet. The portion of the clamping unit where upper clamp portion 312 meets the lower clamp portion also serves as a stopper against movement of the board in the opposite direction (into the drawer opening).

Also shown in FIG. 9 is another board 319 held in channels of additional clamping units 10, which are secured to one side of board 42. This illustrates the versatility of the clamping units.

Figure 10:
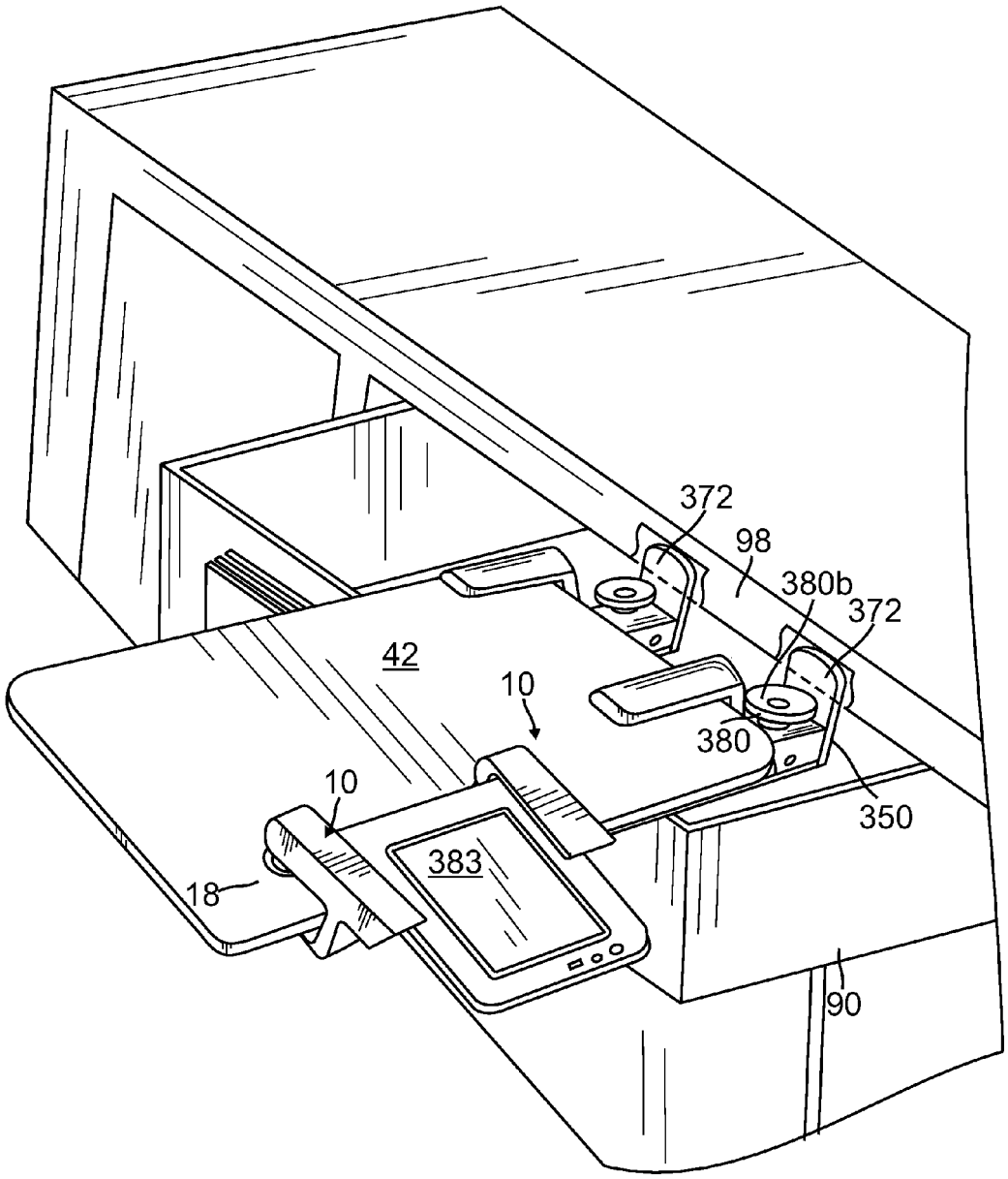
FIG. 10 is an in-use view of the pair of clamping units of FIG. 8 with portions of the drawer cabinet surface cut away, where the rear retractable stops do not touch the underside of the front face of the desk but extended abutting members of the clamping units touch the underside of the desk's top surface.

FIG. 10 is a cutaway view of the clamping units 310 of FIG. 9 with portions of front wall 98 cutaway and indicated in dashed lines so that one can see rear clamp portion 350 behind the front wall 98 of the cabinet, including extended abutting member 372. In this view, instead of the rear retractable stop 380 abutting the underside of the front wall, the extended abutting member 372 contacts the underside of the top of the cabinet which is visible in the cutaway view of FIG. 10. However, the dimensions of the rear clamp portion 350 including the height of the extended abutting member 372 and the position of the rear retractable stop 380, and the front wall 98 and the underside of the top of the cabinet from the bottom edge of the front wall, may be such that both the extended abutting member 372 and the rear retractable stop 380 contact the underside of the top of the cabinet and the bottom edge of the front wall 98, respectively. Stop 380 may include a threaded screw by which it is secured to the rear clamp portion 350 as the stops, such as stop 18, in other embodiments, so that the stop 380 may be extended or shortened by rotating it counterclockwise or clockwise, similar to the retractable stop 18 positioned on the lower clamp portion.

The rear retractable stop 380 may be configured to abut the lower edge of the front cabinet wall 98 above the open drawer 90 while the board is supported by an upper edge of a front surface of said drawer. The rear retractable stop 380 may be used in this manner if the upper ceiling of said drawer opening is positioned too high to allow abutting contact by the extended abutting member 372. This may often be the case if the drawer opening being used to support the board is not the uppermost drawer of the drawer cabinet. The surface of the rear retractable stop 380 may be comprised of a high friction material such as rubber or soft plastic to increase frictional contact with the lower edge of the front cabinet wall 98.

The extended abutting member 372, preferably disposed at a rear of the clamping unit, extends vertically above an adjacent portion of the clamping unit that is located in the direction of the upper clamping arm and lower clamping portion, a sufficient amount so as to accommodate a typical distance that the front wall 98 of the cabinet or the like protrudes downward from an underside of the top of the drawer opening or the top of the cabinet. This amount is preferably one and one quarter inch (1¼").

Also shown in FIG. 10 is a computer such as a lap top, notebook or tablet computer 383 held in channels of additional clamping units 10. These additional clamping units 10 are inverted with respect to the clamping units 10 of FIG. 9, so that stops 18 of the lower clamp portions engage the top of board 42, and the upper clamp arms engage the bottom of board 42. This further illustrates the versatility of the clamping units.

Figure 11A:
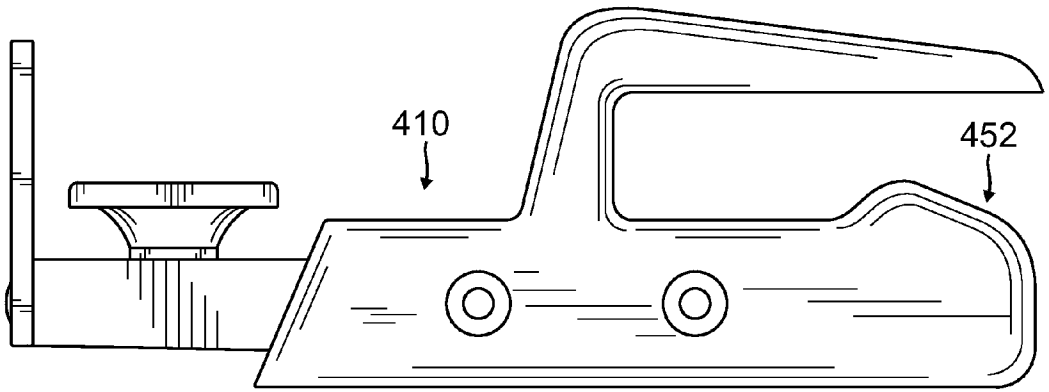
FIG. 11A is a side view of a clamping unit in accordance with a fourth embodiment of the invention.
Figure 11B:
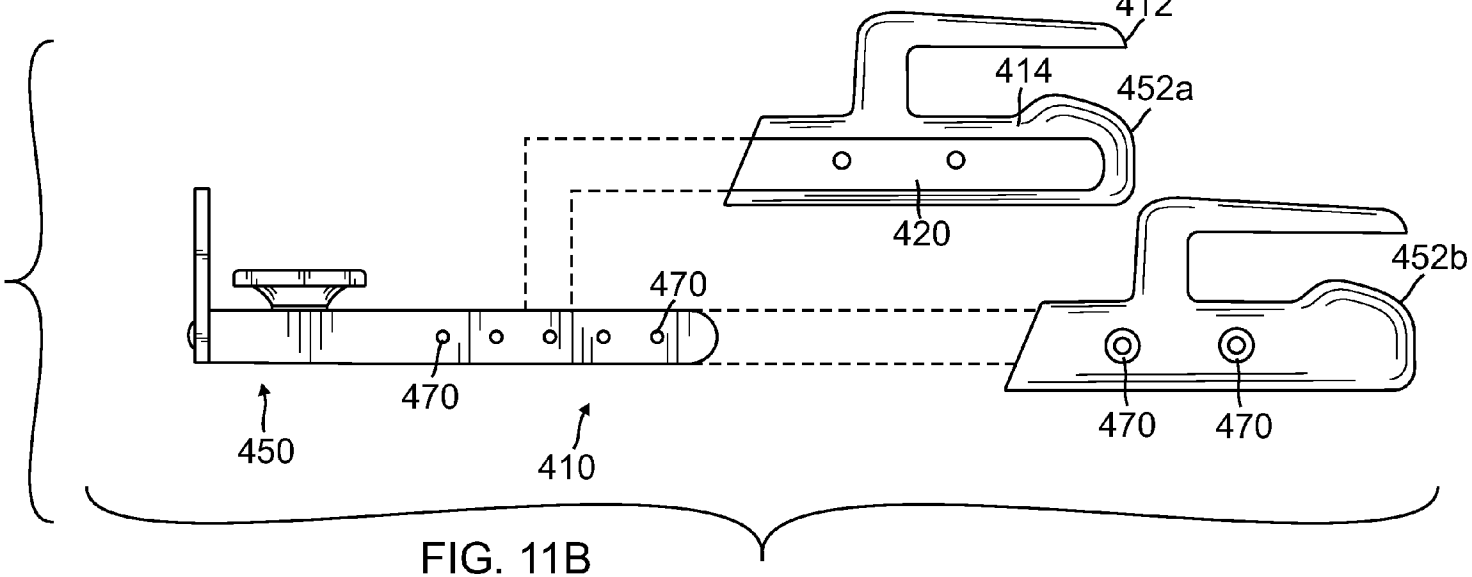
FIG. 11B is an exploded view of the clamping unit of FIG. 11A.

FIGS. 11A and 11B show another embodiment of a clamping unit providing similar functionality as the embodiments of FIGS. 7 through 10. Clamping unit 410 has a front clamp portion 452, a rear clamp portion 454, an upper clamp arm 412, a lower clamp portion 414, and a receiving channel 420 as discussed in the previous embodiments. The front clamp portion 452 may be configured so to be formed from two mirror image front clamp halves 452*a* and 452*b* (or if desired, just one "half"). Preferably, the two halves 452*a* and 452*b* are such that they form a fully assembled front clamp portion 452 in a clam shell fashion. Thus, front clamp portion 452 has two receiving channels 420 which are aligned to define the interior opening for inserting and securing rear clamp portion 454. Specifically, rear clamp portion 454 may include an extending connecting member 410 configured to be inserted into the opening defined by the clam-shell and secured to the front clamp halves.

The mirror image front clamp halves may both include receiving channels on opposing sides (the outside surfaces) such that the two mirror image halves may be utilized in the uses previously discussed above in FIGS. 1 through 6.

The embodiment may further provide for corresponding securing holes 470 on the front clamp halves and the extended connecting member 410 of the rear clamp portion, and may further provide securing screws (not pictured) to fix the rear clamp portion 450 and assembled front clamp portion 452 together.

Figure 12:
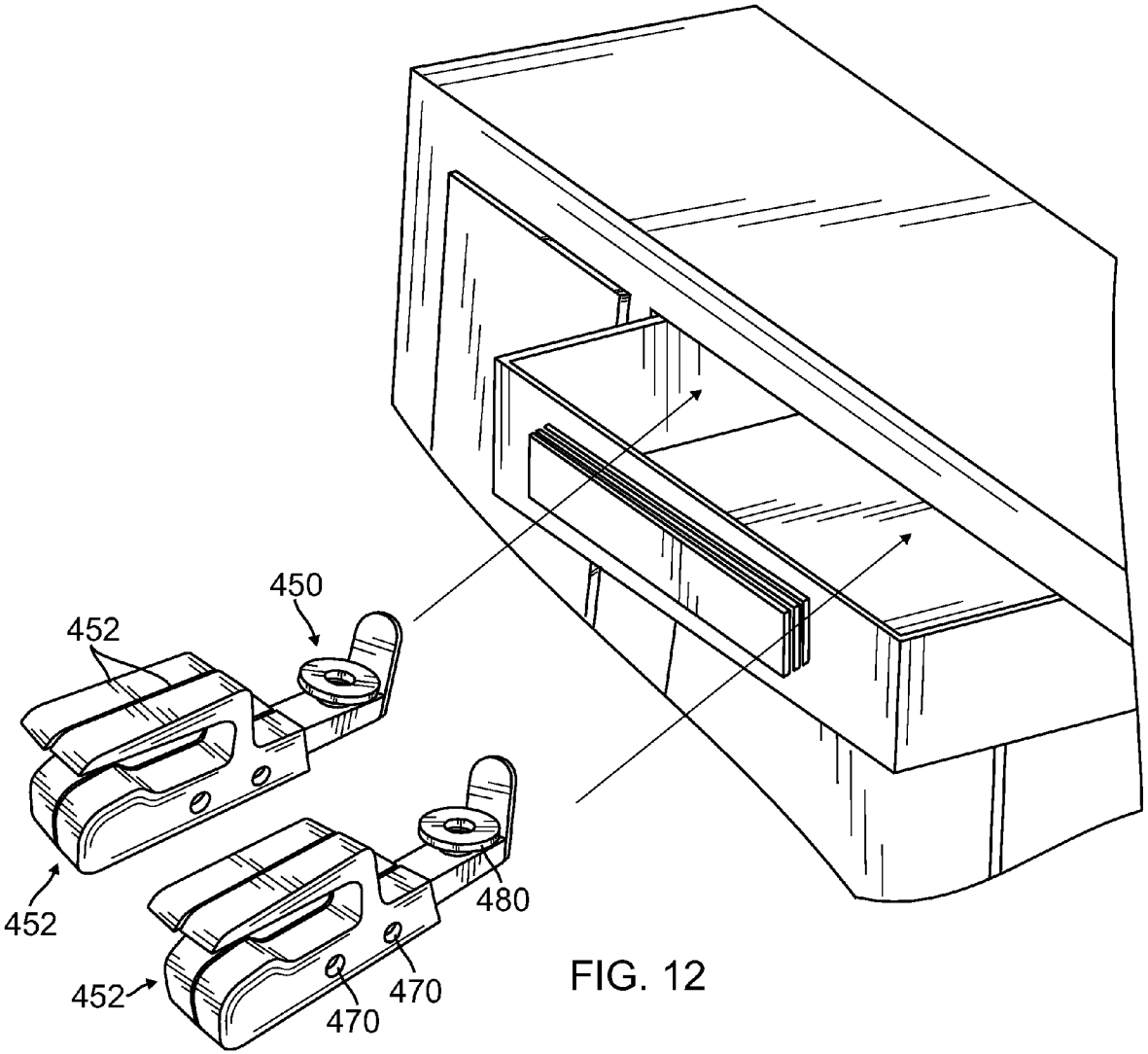
FIG. 12 is an in-use view of the pair of clamping units of FIG. 11B.

FIG. 12 is an in-use view of the clamp units of FIG. 11. The clamp units 410 are shown in their fully assembled state wherein the front clamp assemblies 452 includes the two mirror image front clamp halves 452. The clamping units may be used as discussed above in FIG. 9 to secure a board above a drawer opening to provide for additional work space or storage space next to a tabletop, countertop, or other substantially flat surface. The rear clamp portion 450 may include rear retractable stop 480 similar to in the rear retractable stop 380 in FIG. 9.

Figure 13:
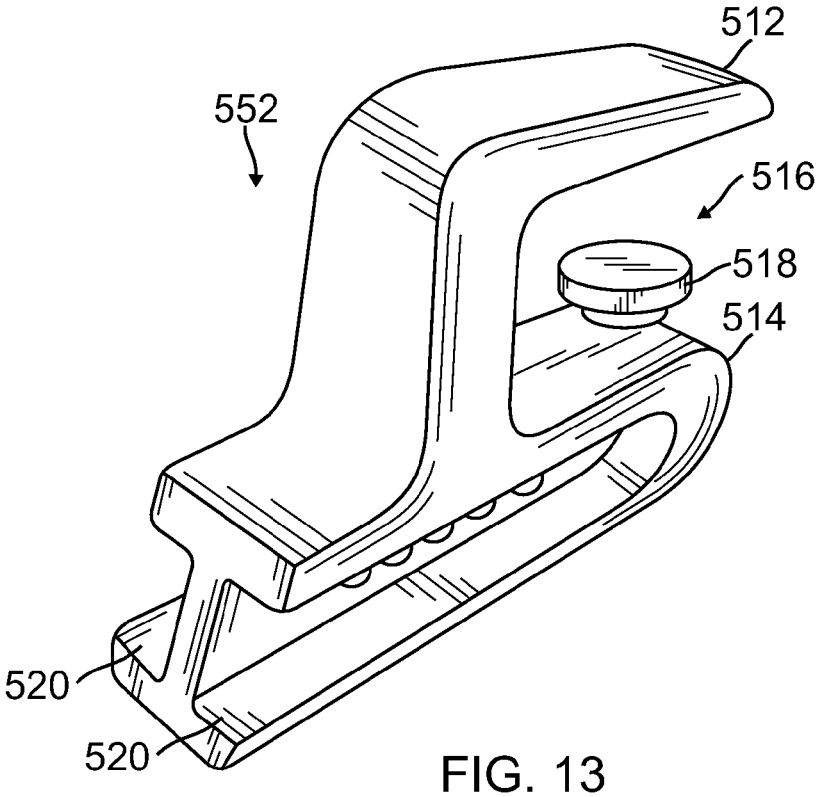
FIG. 13 is a perspective view of a clamping unit in accordance with a fifth embodiment of the invention.
Figure 14:
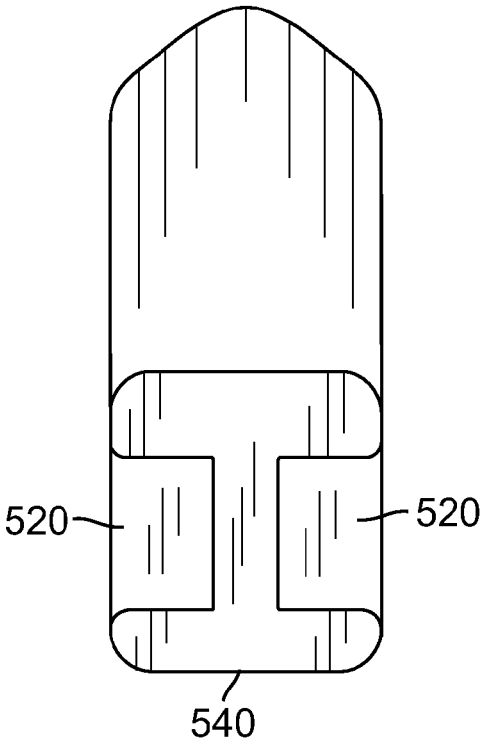
FIG. 14 is a rear view of the clamping unit of FIG. 13.

FIGS. 13 and 14 show an alternative front clamp portion. This embodiment preferably shares some of the structure and features of the embodiment of FIGS. 1 through 4 as will be evident to one of ordinary skill in the art. Front clamp portion 552 may include an upper clamp arm 512 and a lower clamp portion 514 defining a clamp void 516, and it may further include a retractable stop 518. The embodiment may further include receiving channels 520 positioned on both sides of the front clamp. The receiving channels may be used to secure the lip or edge of a container as discussed above with respect to FIG. 3.

FIG. 14 is a rear view of the clamping unit of FIG. 13. Receiving channels 520 positioned on either side of the clamping unit are visible. The receiving channels 520 may be configured to receive and secure the lip or edge of a container. Positioning receiving channels 520 on both sides enables the clamping unit to be used either in the left or right position when used in conjunction with a second clamping unit to secure a container as discussed above in FIG. 3, thus eliminating the need to differentiate between left and right configurations and enabling manufacture of just one type of clamping unit.

In FIG. 14, the substantially flat clamp bottom surface 540 is also visible. This configuration of the substantially flat clamp bottom surface 540 allows the front clamp portion 552 to be rested on a tabletop, countertop, or other substantially flat surface while elevating a flat working board or cutting board as in FIG. 4.

Figure 15A:
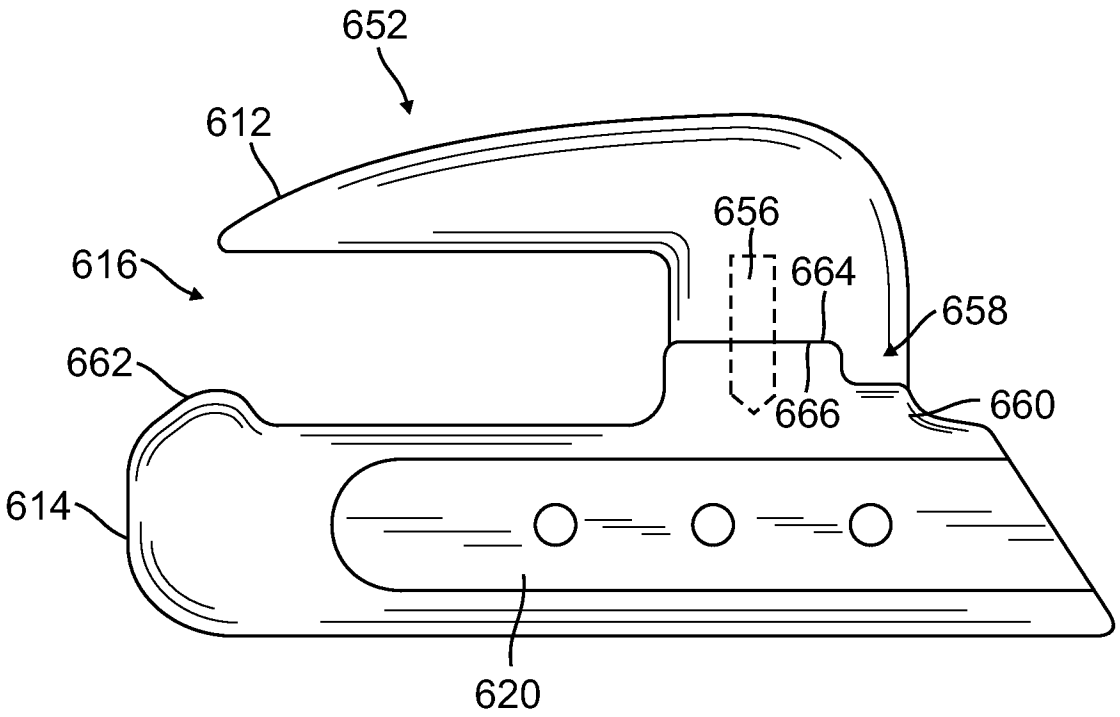
FIG. 15*a* is a side view of a clamping unit in accordance with a sixth embodiment of the invention.
Figure 15B:
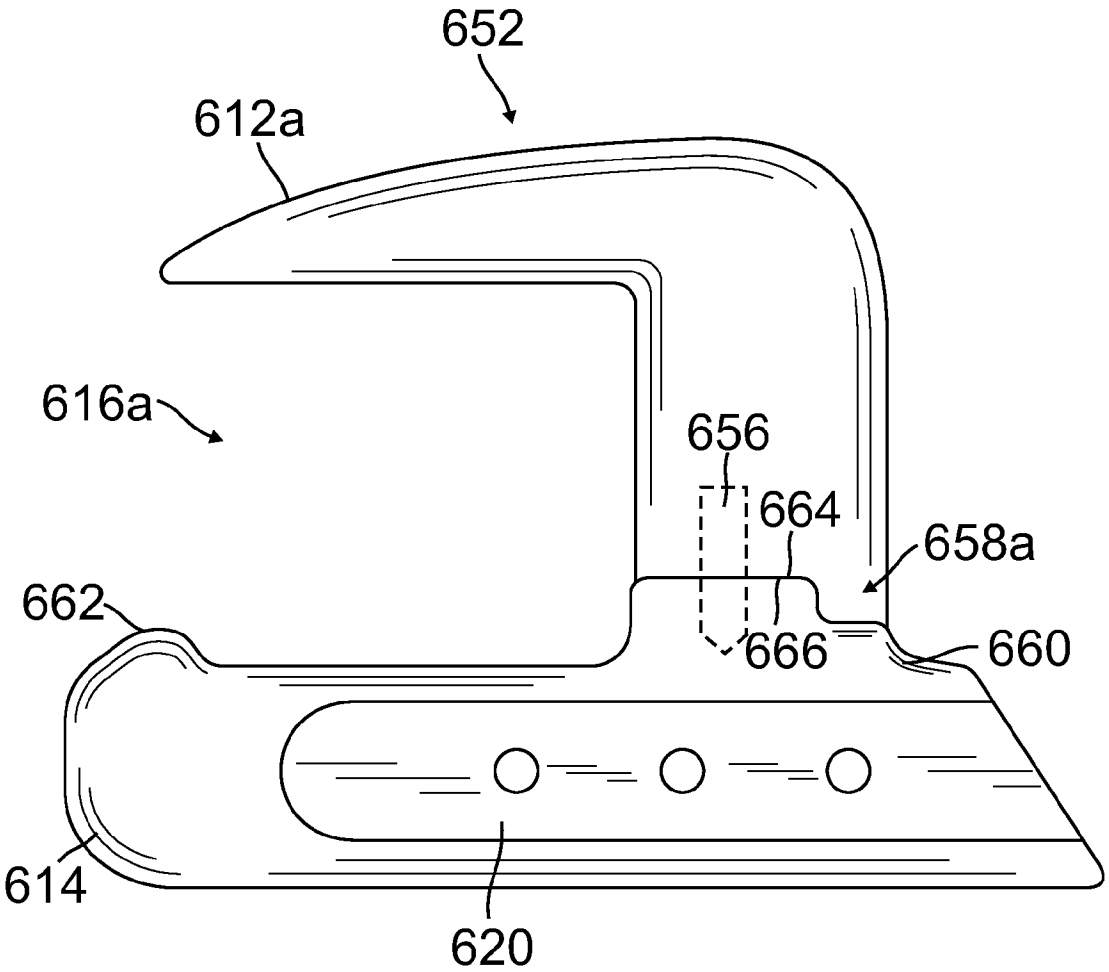
FIG. 15*b* is a side view of an alternate configuration of the clamping unit of FIG. 15*a*.

FIGS. 15*a* and 15*b* show alternative front clamp portions which share some of the structure and features of the embodiment of FIGS. 13 and 14 as will be evident to one of ordinary skill in the art. Referring now to FIG. 15*a*, front clamp portion 652 may include the same features as discussed above, such as an upper clamp arm 612 and a lower clamp portion 614 defining a clamp void 616, as well as receiving channels 620 positioned on both sides of the front clamp. In the depicted embodiments, lower clamp portion 614 includes a protruding front member 662 for securing a surface edge within clamp void 616. Protruding front member 662 may be composed of a resilient material to accommodate varying widths of surface edges to be secured within clamp void 616. Lower clamp portion 614 may alternatively include a retractable stop for securing a surface edge within void 616 as in FIG. 1. Front clamp portion 652 may further be configured such that upper clamp arm 612 is removably attached to lower clamp portion 614.

Front clamp portion 652 may include clamp arm connector 656 which is positioned to provide a secure connection between upper clamp arm 612 and lower clamp portion 614. Clamp arm connector 656 may be a threaded screw, bolt, or the like, affixed to the upper surface 666 of lower clamp portion 612 and configured to be inserted into a threaded opening positioned on the bottom surface 664 of upper clamp arm 612. In this embodiment, the user is able to secure the upper clamp arm 612 to lower clamp portion 614 by inserting clamp arm connector 656 into the threaded opening of upper clamp arm 612 and rotating upper clamp arm 612 in a first direction, e.g., a clockwise direction until a secure fit is accomplished; and the user may remove upper clamp arm 612 by rotating it in a second direction, e.g., counterclockwise direction (or visa versa). Alternatively, clamp arm connector 656 may be securely affixed to the bottom surface 664 of upper clamp arm 612 such that the clamp arm connector 656 is inserted into an opening positioned on the upper surface 666 of lower clamp portion 614. In another embodiment, clamp arm connector 656 may include a notched bolt or rod structure configured to snap securely into place when inserted into an opening positioned on the bottom surface 664 of upper clamp arm 612, which may be configured to receive and secure the notched clamp arm connector 656.

Upper clamp arm 612 may further include a notched bottom surface 658 configured to align with lower clamp arm 614 which may be configured with a corresponding notched upper surface 660. The corresponding notched surfaces 658, 660 may provide a secure fit between upper clamp arm 612 and lower clamp portion 614 and additionally prevent unintentional rotation of upper clamp arm 612 in relation to lower clamp portion 614 when front clamp portion 652 is in use.

These configurations may allow upper clamp arm 612 to be interchangeable by the user such that the user is able to utilize various sizes and configurations of upper clamp arm 612 to best suit the user's needs. For example, FIG. 15*a* depicts front clamp portion 652 wherein upper clamp arm 612 is configured to define clamp void 616 such that the void is capable of receiving and securing a surface edge (such as an edge of a table, shelf, working board, or cutting board) measuring approximately ⅜" to ½" in width. Alternatively, FIG. 15*b* shows front clamp portion 652 wherein upper clamp arm 612 of FIG. 15*a* has been removed and replaced with another configuration of upper clamp arm 612*a* configured to define clamp void 616*a* measuring approximately ⅝" to ¾", and having a notched surface 658*a* like notched surface 658. Other configurations may provide various upper clamp arm configurations with varying predetermined heights such that the user is able to accommodate a wide range of widths of the surface edge to be secured within clamp void 616. The various replacement upper clamp arms for voids of varying height may be sold together in a kit.

In another configuration, upper clamp arm 612 may be secured to lower clamp portion 614 to define clamp void 616 without fully inserting clamp arm connector 656 into the opening positioned either on the bottom surface 664 of upper clamp arm 612 or upper surface 666 of lower clamp portion 614. In this configuration, the height of upper clamp arm 612 in conjunction with the height of the portion of clamp arm connector 656 remaining un-inserted and exterior to the opening may define the height of clamp void 616. In this way, the user may adjust the height of clamp void 616 in finer gradual adjustment increments as compared to interchanging varying sizes of upper clamp arm 612 which offer only predetermined incremental adjustments. This ability may also aid in ensuring a firm and secure grip between the upper clamp arm 612 and lower clamp portion 614 about an edge of a surface inserted into clamp void 616.

Figure 16:
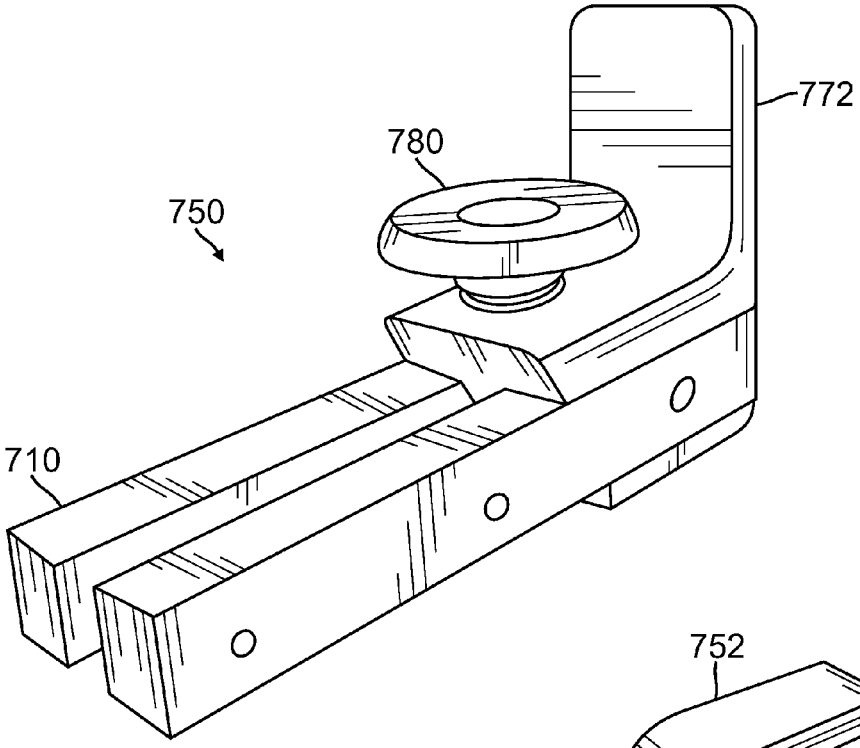
FIG. 16 is a perspective view of rear clamp portion configured to be used in conjunction with the clamping unit of FIGS. 13 and 14.
Figure 17:
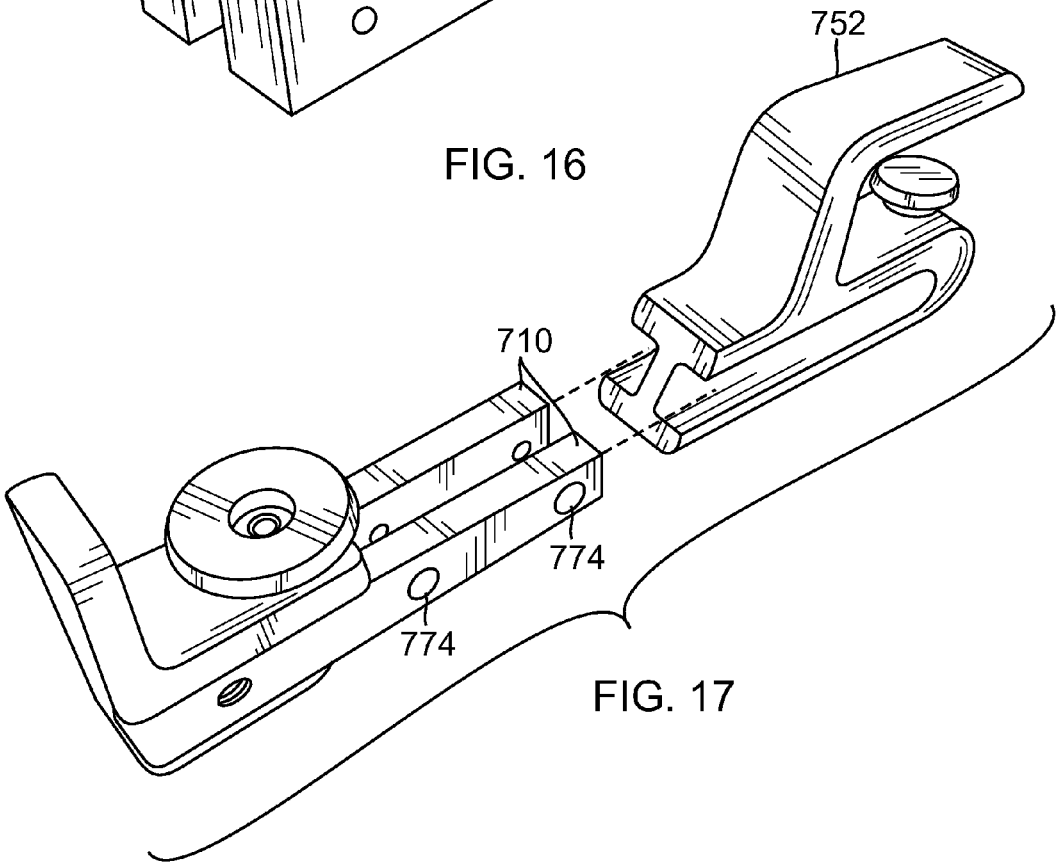
FIG. 17 is a perspective view of the clamping unit of FIG. 13 in combination with the rear clamp portion of FIG. 16.

FIG. 16 shows an embodiment of a rear clamp portion 750 of a clamping unit configured to be compatibly used in conjunction with the front clamp embodiment as discussed above with reference to FIGS. 13 through 15*a* and 15*b*. The rear clamp portion 750 may include an extended abutting member 772 like that discussed above with reference to FIGS. 7*a* and 7*b*, and a rear retractable stop 780 like that discussed above with reference to FIG. 10. The depicted embodiment may further include an extended connecting member 710 configured to be inserted and secured within the receiving channels of the front clamp portion. The extended connecting member 710 may include two separate extended connecting member portions, the connecting member portions configured to be inserted and secured within the two receiving channels positioned on either side of the front clamp portion as discussed above in FIG. 14. Furthermore, as shown in FIG. 17, the extending connecting member portions 710 may further include securing holes 774 which correspond to securing holes positioned within the receiving channels of the front clamp portion, the securing holes configured to align and receive screws (not pictured) to secure the front clamp portion 752 and rear clamp portion 750 together.

Figure 18:
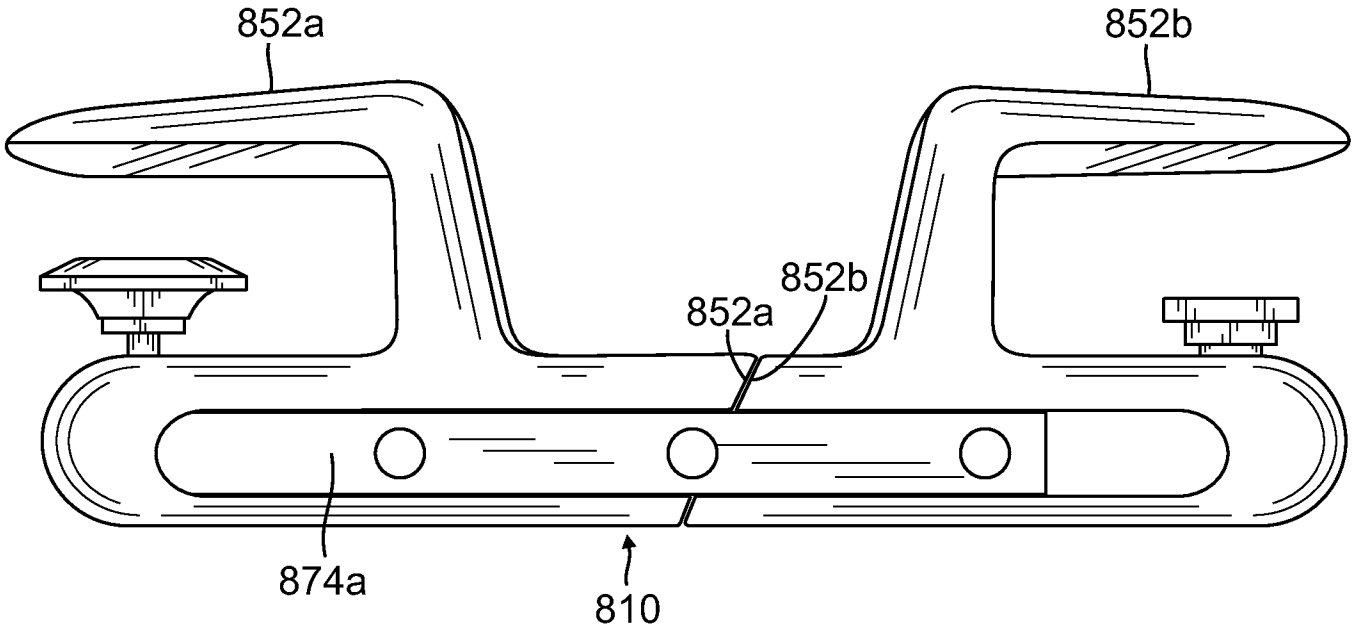
FIG. 18 is a side view of a clamping unit in accordance with a seventh embodiment of the invention.

FIG. 18 shows another embodiment of a clamping unit 810. In this embodiment, there are two front clamp portions 852 constructed so that they may be used in combination to form clamping unit 810, which is in essence a dual clamping unit. In this embodiment, both front clamp portions 852 may share some of the structure and features of the embodiments as discussed above with reference to FIGS. 1 through 4, and 13 through 15*b*. The two front clamp portions 852 may be configured to align end to end at a rear end of each front clamp portion (remote from the void.)

The first front clamp portion 852A may include an angled rear-facing surface 852*a* or a unique shape such that the rear end of said first clamp portion may align with a second front clamp portion 852B having a rear-facing surface 852*b* with a matching opposite angled surface or unique shape. In another embodiment, the front clamp portions may include rear surfaces configured to be substantially flat and non-angled such that the two front clamp portions do not need to be differentiated.

The front clamp portions 852A and 852B of FIG. 18 may utilize structure of the front clamp portions of FIGS. 13, through 15*b*. In these embodiments, the extending connecting member 874A may be removable from both front clamp portions 852A and 852B. The extending connecting member 874A may be secured to each front clamp portion by securing screws (not pictured), and may be removed by the user.

Figure 19:
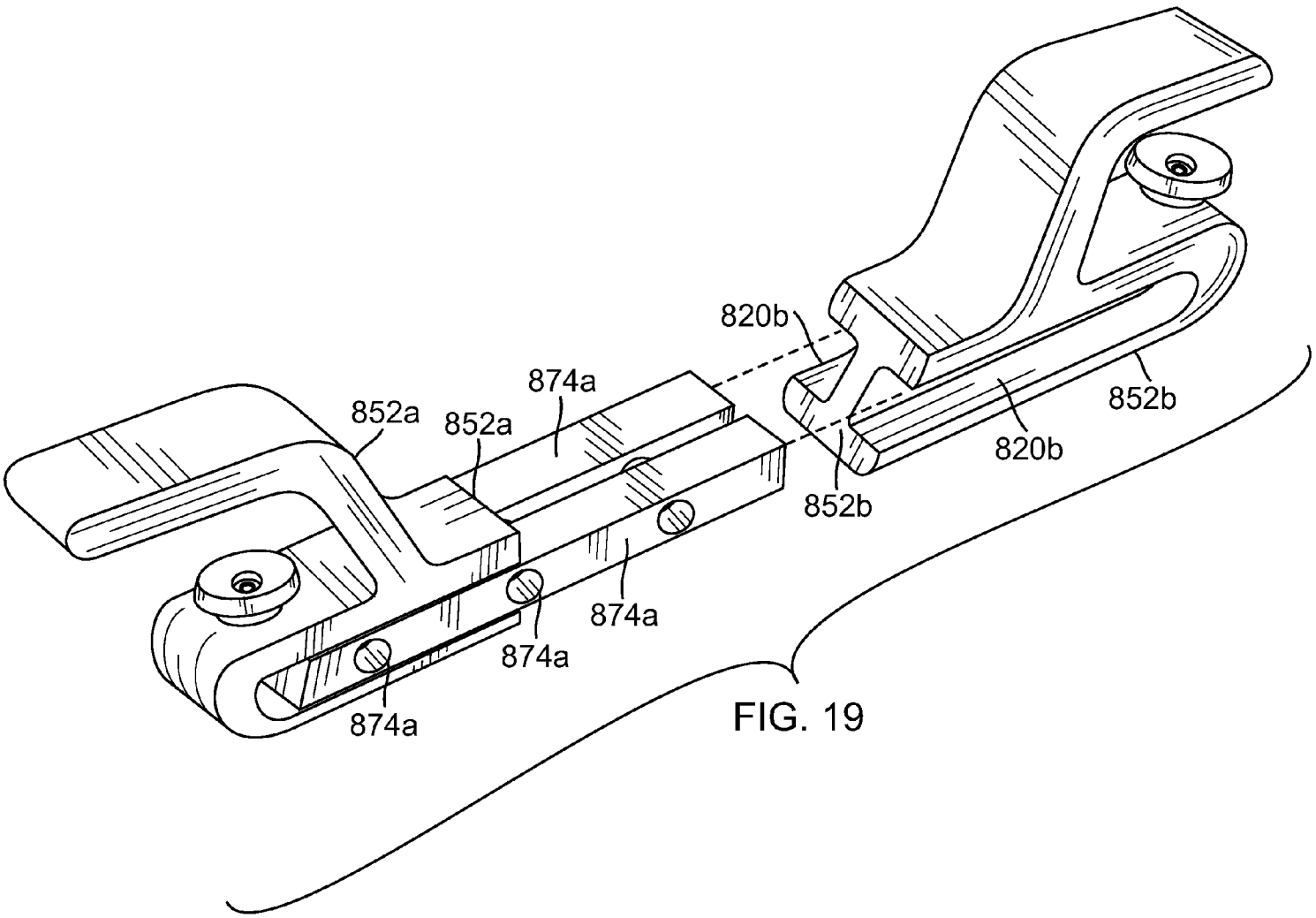
FIG. 19 is a perspective view of the clamping unit of FIG. 18 with its components separated.

As shown in FIG. 19, the extending connecting member or members 874A may be used to connect and secure both front clamp portions 852A and 852B by inserting extending connecting members 874A into respective receiving channels 820B on front clamp portion 852B. The extending connecting members 874A may be secured to the two front clamp portions 852A and 852B by securing screws (not pictured) inserted into the corresponding securing holes 874*a* located on the extending connecting portion, and the two front clamp portions 852A and 852B.

The embodiment depicted in FIGS. 18 and 19 may be used to secure a working board or cutting board type device above a drawer opening as discussed above with reference to FIG. 9. In this use, one front clamp portion (e.g., 852A) may be used to secure the cutting board within the clamp void, while the other front clamp portion (e.g., 852B) may be used to secure the dual clamping unit to the upper surface of a drawer cabinet. Alternatively, this dual clamping unit may be utilized such as discussed above with reference to FIG. 3, where the clamping unit is used to secure a container or a board to the edge of a tabletop, countertop, shelf, or other substantially flat surface. One end of the clamping unit may be used to secure the edge or lip of a container, or a cutting board like surface, while the other end of the clamping unit may be used to secure the clamping unit to the edge of the tabletop, countertop, or other flat surface. In this use, more than one dual clamping unit may be used in combination to provide stability in securing the container or other board.

Figure 20:
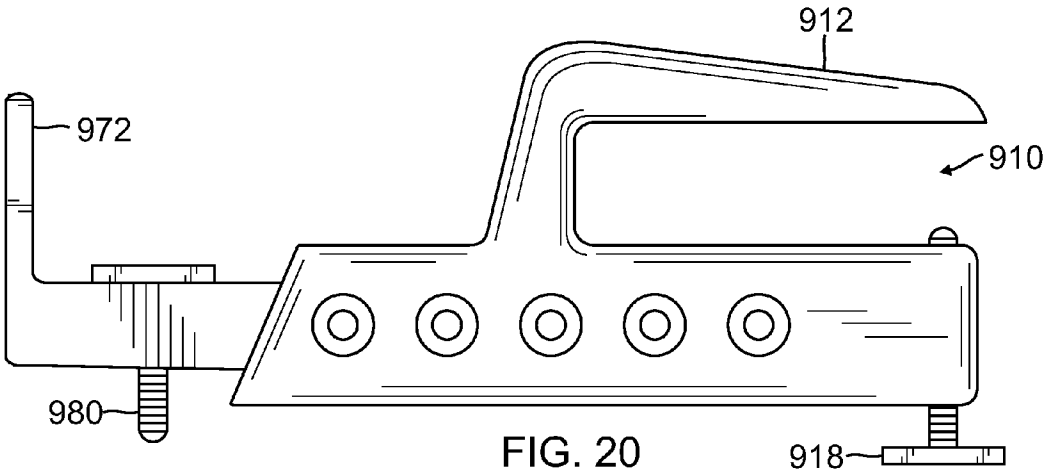
FIG. 20 is a perspective view of a clamping unit which is a variation of FIG. 11A.

In FIG. 20 there is shown a clamping unit which is a variation of that of FIG. 11A, where clamping unit 910 is injection molded in one piece to the extent possible (as is preferred). In fact, each embodiment of the invention disclosed herein is preferably injection molded, in which case stoppers and other portions shown as a screw or a separate attachment may be made in one piece. In FIG. 20, upper clamping arm 912 is unitary with the rest of the front clamping arm. In addition, adjustment screw or stop 918 (which may also have a head as in other embodiments) is movable up and down in either direction of arrow X. Extended abutting member 972 is unitary with the rest of the rear clamp portion. The rear clamp portion also has a rear retractable stop 980.

Figure 21:
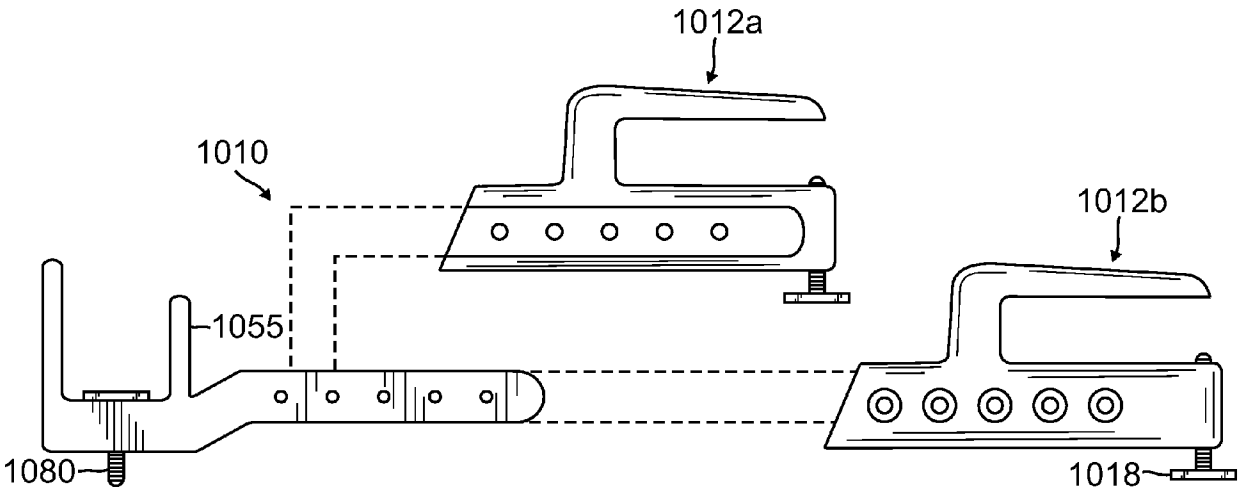
FIG. 21 is a perspective view of a clamping unit which is a variation of that of FIG. 11B.

FIG. 21 is a perspective view of a clamping unit 1010 which is a variation of that of FIG. 11B. Clamping unit 1010 has an upper clamping arm 1012*a* on a front clamping member which may receive in its channel a rear clamp portion. The rear clamp portion has an extended abutting member 1072 and may also have a projection 1055 for helping keep the clamping unit in stable position, when used in an embodiment such as that of FIGS. 9 and 10. The front panel 96 of the desk will be between the extended abutting member 1072 and the projection 1055. Note also that the rear clamp portion has a downward bend that helps to provide proper clearance for some front panels of desks or the like. The front clamping arm has a retractable stop 1018 movable in either direction of arrow X, and the rear clamp portion also has a rear retractable stop 1080. FIG. 21 shows mirror image front clamping portions. Left side front clamping member has upper clamping arm 1012*a* and right side front clamping member has an upper clamping arm 1012*b*. One or the other may be used with the rear clamp member, or both. The length that the rear clamp member extends from the front clamping member is adjustable as in FIG. 20.

Although the invention has been described using specific terms, devices, and/or methods, such description is for illustrative purposes of the preferred embodiment(s) only. Furthermore, the uses of the invention described herein are for exemplary purposes only, and are not intended to limit the scope or structure of the present invention. Changes may be made to the preferred embodiment(s) by those of ordinary skill in the art without departing from the scope of the present invention, which is set forth in the following claims. In addition, it should be understood that aspects of the preferred embodiment(s) generally may be interchanged in whole or in part.

What is claimed is:

1. A multifunction clamp apparatus comprising two clamps, each of the two clamps comprising:

an upper clamp arm and a lower clamp portion and means disposed at at first end of the upper clamp arm and proximate a first end of the lower clamp portion for connecting the upper clamp arm and lower clamp portion together, the upper clamp arm and lower clamp portion defining a void therebetween configured to receive an edge of a flat surface object, and the void facing in a first direction away from the first end and away from the means for connecting, wherein the upper clamp arm and lower clamp portion have opposing surfaces substantially parallel to each other;

a straight elongate receiving channel positioned on one side of the clamp and formed by a recess in the lower clamp portion, the receiving channel configured to receive an elongate protruding edge of an object to be secured, the receiving channel having one open end facing a second direction opposite the first direction and located at the first end of the lower clamp portion and extending toward a second end of the lower clamp portion and ending prior to the second end, the receiving channel being substantially parallel to the opposing surfaces of the upper clamp arm and lower clamp portion;

wherein the lower clamp portion has a protrusion proximate the second end of the lower clamp portion which protrusion is unitary with the lower clamp portion and extending into the void for securing a surface edge within clamp void; and wherein the upper clamp arm and lower clamp portion with the protrusion form a clamping portion configured to be secured about an edge of a flat surface object when disposed about an edge of a flat surface object.

2. The multifunction clamp of claim 1, further comprising:

a retractable stop positioned on the lower clamp portion, the retractable stop configured to be extended into the void to grip an edge of a flat surface object.

3. The multifunction clamp of claim 1, wherein the receiving channel on the one side comprises a first receiving channel, and wherein the clamp further comprises:

a second receiving channel positioned on another side of the clamp opposite the one side, the second receiving channel configured to receive a protruding edge of a container to be secured.

4. The multifunction clamp of claim 1, wherein the upper clamp arm is removably secured to the lower clamp portion.

5. A multifunction clamp apparatus comprising two clamps, each of the two clamps comprising:

an upper clamp arm and a lower clamp portion and a connection portion disposed at first end of the upper clamp arm and proximate a first end of the lower clamp portion the upper clamp arm and lower clamp portion, the upper clamp arm and lower clamp portion defining a void therebetween configured to receive an edge of a flat surface object, and the void facing in a first direction away from the first end and away from the connection mechanism, wherein the upper clamp arm and lower clamp portion have opposing surfaces substantially parallel to each other;

a receiving channel positioned on one side of the clamp, the receiving channel configured to receive a protruding edge of an object to be secured, the receiving channel having one open end facing a second direction opposite the first direction and extending in the second direction; and wherein the upper clamp arm and lower clamp portion form a clamping portion configured to be secured about an edge of an object when disposed about an edge of an object.

6. The multifunction clamp of claim 5, further comprising:

a retractable stop positioned on the lower clamp portion, the retractable stop configured to be extended into the void to grip an edge of a flat surface object.

7. The multifunction clamp of claim 5, wherein the receiving channel on the one side comprises a first receiving channel, and wherein the clamp further comprises:

a second receiving channel positioned on another side of the clamp opposite the one side, the second receiving channel configured to receive a protruding edge of a container to be secured.

8. The multifunction clamp of claim 5, wherein the upper clamp arm is removably secured to the lower clamp portion.

9. The multifunction clamp of claim 5, wherein the positioning of the upper clamp arm is adjustable relative to the lower clamp portion to adjust the height of the opening of the void defined therebetween.

* * * * *